US009651340B1

(12) United States Patent
Tunis, III et al.

(10) Patent No.: US 9,651,340 B1
(45) Date of Patent: May 16, 2017

(54) BALLISTIC RESISTANT VEHICLE WINDOW INSERT

(71) Applicants: Hardwire, LLC, Pocomoke City, MD (US); George C. Tunis, III, Pocomoke City, MD (US)

(72) Inventors: George C. Tunis, III, Ocean City, MD (US); Scott Kendall, Ocean City, MD (US); Justin Gordon, Snow Hill, MD (US)

(73) Assignee: Hardwire, LLC, Pocomoke City, MD (US)

( * ) Notice: Subject to any disclaimer, the term of this patent is extended or adjusted under 35 U.S.C. 154(b) by 0 days.

(21) Appl. No.: 15/192,040

(22) Filed: Jun. 24, 2016

Related U.S. Application Data

(63) Continuation of application No. 15/146,947, filed on May 5, 2016.

(60) Provisional application No. 62/157,180, filed on May 5, 2015.

(51) Int. Cl.

| | |
|---|---|
| ***F41H 5/26*** | (2006.01) |
| ***E06B 9/00*** | (2006.01) |
| ***E06B 5/10*** | (2006.01) |
| *F41H 5/04* | (2006.01) |

(52) U.S. Cl.
CPC ..... *F41H 5/263* (2013.01); *E06B 5/10* (2013.01); *E06B 9/00* (2013.01); *F41H 5/0407* (2013.01)

(58) Field of Classification Search
CPC ... F41H 5/26; F41H 5/263; E06B 5/10; E06B 5/106
USPC ..... 296/152; 49/463, 465, 466, 50, 53
See application file for complete search history.

(56) References Cited

U.S. PATENT DOCUMENTS

| | | | | | |
|---|---|---|---|---|---|
| 2,143,266 | A | | 1/1939 | Grondahl | |
| 2,242,606 | A | * | 5/1941 | Duncan | B60J 1/20 292/DIG. 6 |
| 2,540,504 | A | * | 2/1951 | Beneteau | B60J 1/2011 160/229.1 |
| 3,855,898 | A | * | 12/1974 | McDonald | B60R 21/12 109/49.5 |
| 3,923,339 | A | * | 12/1975 | McDonald | B60R 21/12 160/370.21 |
| 5,113,611 | A | | 5/1992 | Rosson | |
| 5,145,381 | A | | 9/1992 | Volz | |
| 5,271,311 | A | * | 12/1993 | Madden, Jr. | B60R 21/12 89/36.02 |
| 5,533,778 | A | * | 7/1996 | Sheridan | F41H 5/263 296/152 |
| 5,594,193 | A | * | 1/1997 | Sheridan | F41H 5/013 109/49.5 |
| 5,619,820 | A | * | 4/1997 | Madden, Jr. | B60R 21/12 49/50 |
| 5,655,343 | A | | 8/1997 | Seals | |
| 5,857,730 | A | * | 1/1999 | Korpi | F41H 5/263 109/49.5 |
| 6,018,916 | A | | 2/2000 | Henry | |

(Continued)

*Primary Examiner* — Gregory Strimbu
(74) *Attorney, Agent, or Firm* — Posternak Blankstein & Lund LLP

(57) ABSTRACT

A window insert assembly providing ballistic protection for a window of a vehicle side door. The window insert assembly includes a window insert formed from a ballistic-resistant material and a wedge assembly to wedge the window insert within a window frame of the vehicle door. A method of providing ballistic protection for the window.

27 Claims, 16 Drawing Sheets

(56) References Cited

U.S. PATENT DOCUMENTS

| | | | | |
|---|---|---|---|---|
| 6,192,628 | B1 * | 2/2001 | Pinheiro | B60J 1/20 160/105 |
| 6,230,446 | B1 | 5/2001 | Chalich | |
| 6,327,954 | B1 * | 12/2001 | Medlin | F41H 5/0407 296/96.21 |
| 6,578,305 | B2 | 6/2003 | Lebrun | |
| 7,063,374 | B1 * | 6/2006 | Cameron | B60J 1/085 109/49.5 |
| 7,114,760 | B2 * | 10/2006 | Cameron | B60J 1/20 109/49.5 |
| 7,469,502 | B1 * | 12/2008 | Steel | E05C 9/06 49/463 |
| 8,176,830 | B1 * | 5/2012 | Tan | F41H 5/0428 89/36.02 |
| 8,544,209 | B2 | 10/2013 | Aschmutat et al. | |
| 9,170,072 | B1 * | 10/2015 | Riggs | F41H 5/06 |
| 2016/0265232 | A1 | 9/2016 | Noble | |

* cited by examiner

BALLISTIC RESISTANT VEHICLE WINDOW INSERT

CROSS REFERENCE TO RELATED APPLICATIONS

This application claims priority under 35 §119(e) of U.S. Provisional Application No. 62/157,180, filed on May 5, 2015, entitled "Ballistic Resistant Vehicle Window Insert," the disclosure of which is hereby incorporated by reference.

This application claims priority under 35 U.S.C. §120 of U.S. application Ser. No. 15/146,947, filed on May 5, 2016, entitled "Ballistic Resistant Vehicle Window Insert," the disclosure of which is hereby incorporated by reference.

STATEMENT REGARDING FEDERALLY SPONSORED RESEARCH OR DEVELOPMENT

N/A

BACKGROUND

Windows in many types of vehicles that are used by law enforcement personnel are typically made of automotive safety glass, but are not generally ballistic-resistant. Thus, the driver or other occupants of the vehicle may be at risk of impact by a ballistic projectile that is aimed at the vehicle.

SUMMARY OF THE INVENTION

A window insert assembly is provided for protection against impacts from ballistic projectiles. The window insert assembly includes a window insert formed from a ballistic-resistant material that can be placed within the existing window frame of a vehicle side door. The window insert assembly does not interfere with operation of the existing stock window.

In some embodiments, a window insert assembly includes a window insert comprising a sheet of a ballistic-resistant material having a perimeter including an upper edge, a rear edge, and a lower edge. At least one of the upper edge and the rear edge include a contour to mate with a window frame of the vehicle door. The window insert assembly also includes an attachment assembly configured to attach the window insert within the window frame of a vehicle door proximate a stock window of the vehicle door. The attachment assembly can be configured to force the window insert upwardly and/or rearwardly against the window frame.

DESCRIPTION OF THE DRAWINGS

The invention will be more fully understood from the following detailed description taken in conjunction with the accompanying drawings in which.

DETAILED DESCRIPTION OF THE INVENTION

Figure 1:
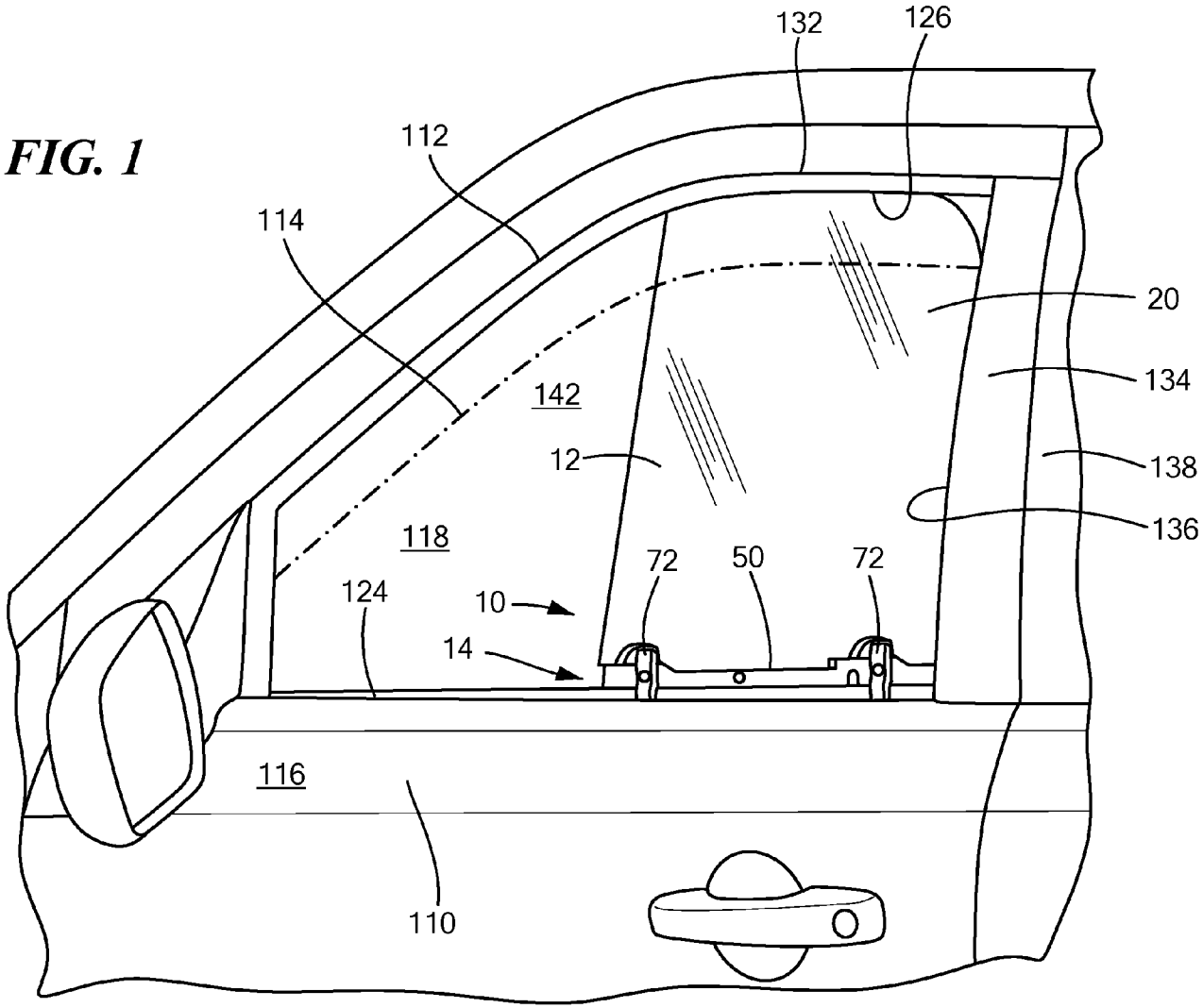
FIG. 1 illustrates a vehicle door with an embodiment of a window insert assembly installed in a vehicle door window frame viewed from the exterior of the vehicle.
Figure 2:
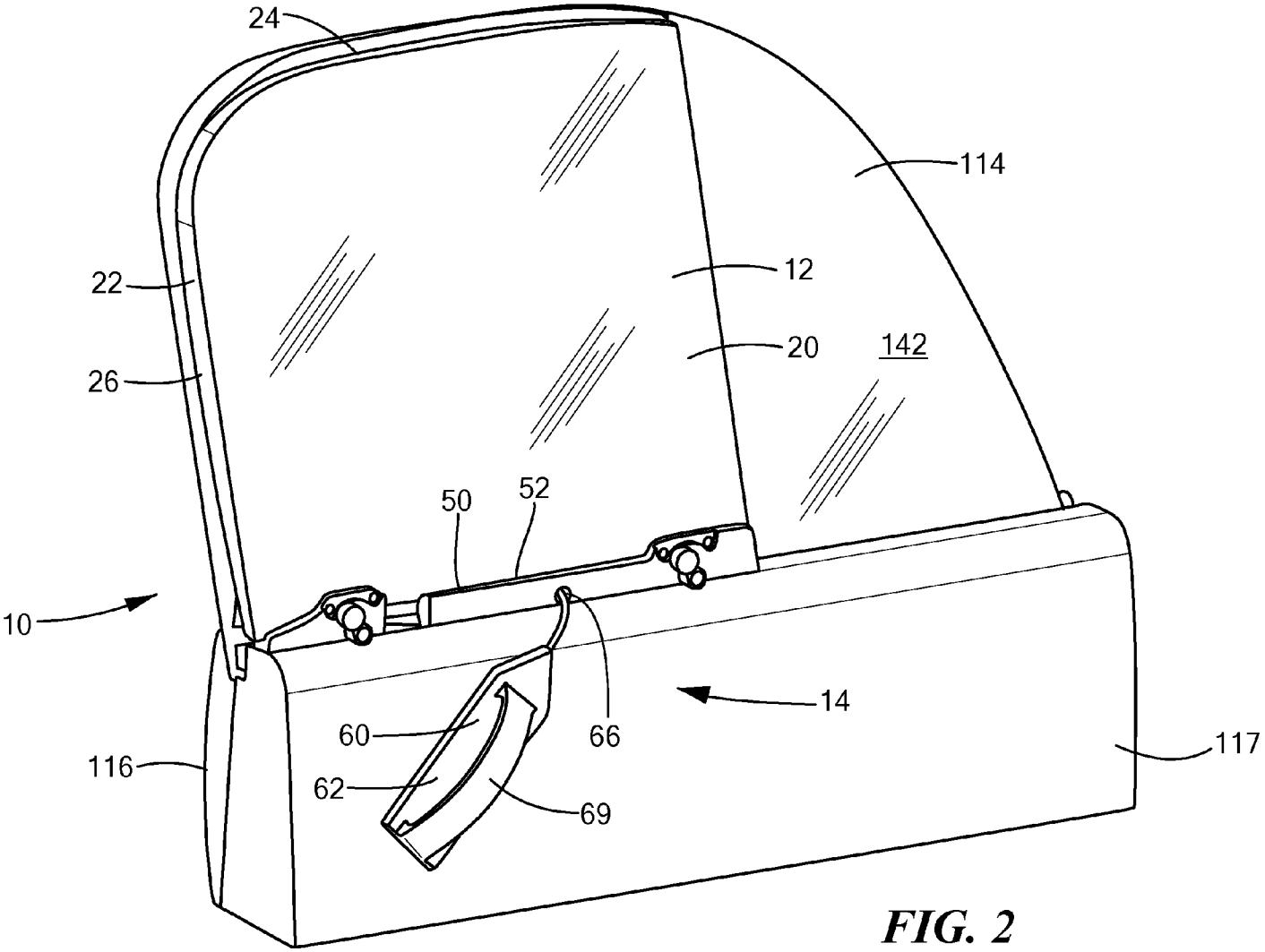
FIG. 2 illustrates a vehicle door with the window insert assembly of FIG. 1 viewed from the interior of the vehicle.
Figure 4:
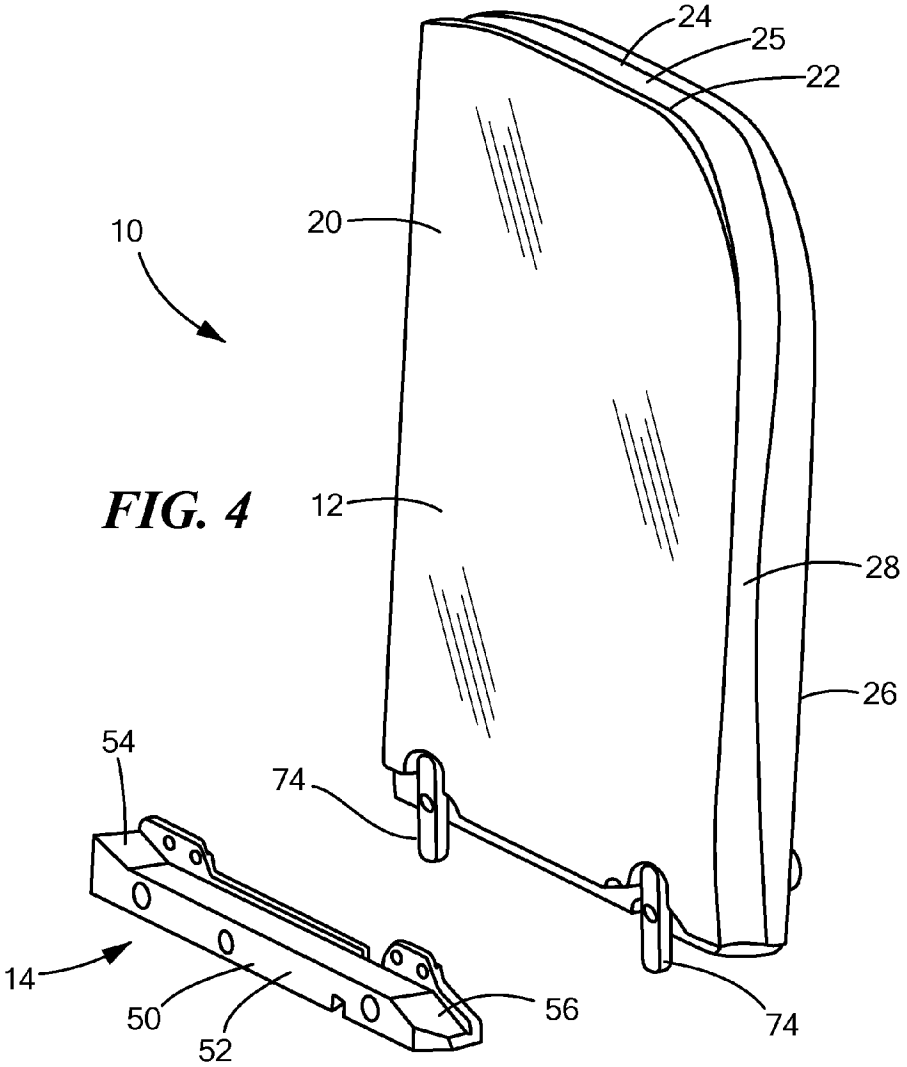
FIG. 4 is an exploded view of the window insert assembly of FIG. 1.

Referring to FIGS. 1 and 2, one embodiment of a window insert assembly 10 for a vehicle door 110 includes a window insert 12 formed of a ballistic resistant material and an attachment assembly 14 that holds the window insert in place within existing structural components forming a window frame 112 for an existing stock window 114 (shown in phantom partially open in FIG. 1) of the vehicle door. The window insert 12 can cover an area within the window frame that can provide protection to the head and neck of a person sitting in the seat adjacent the vehicle door against a projectile directed at the stock window. The window insert 12 can be retained on the interior side of the door's existing stock window and does not interfere with opening and closing of the stock window using the window mechanism present in the door.

Figure 3:
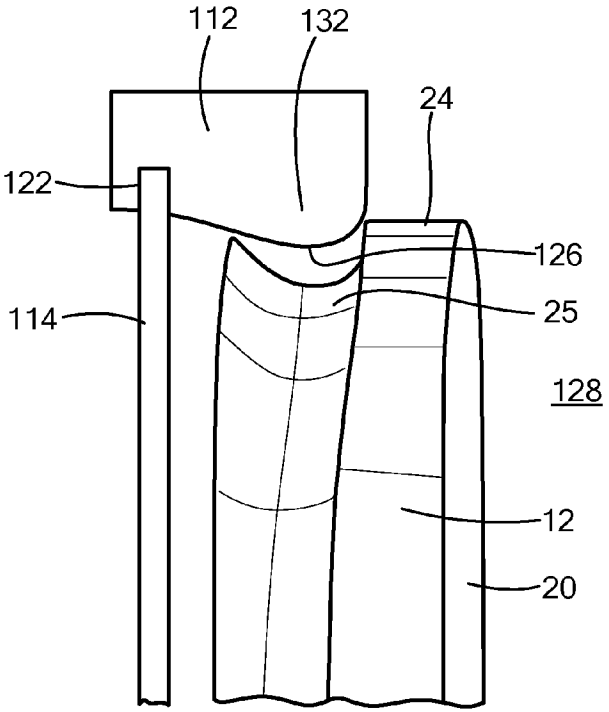
FIG. 3 is a schematic partial view of a contoured upper edge of the window insert of FIG. 1 engaging an upper edge of a vehicle door window frame.
Figure 6:
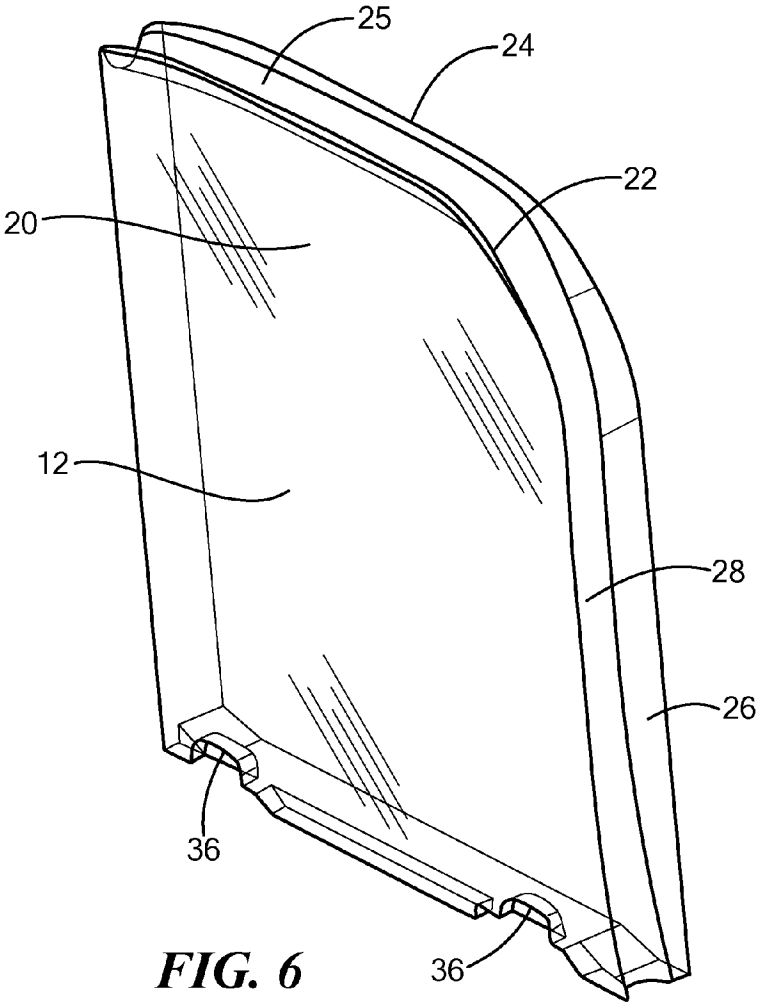
FIG. 6 is an upper isometric view of the window insert of FIG. 1.
Figure 5:
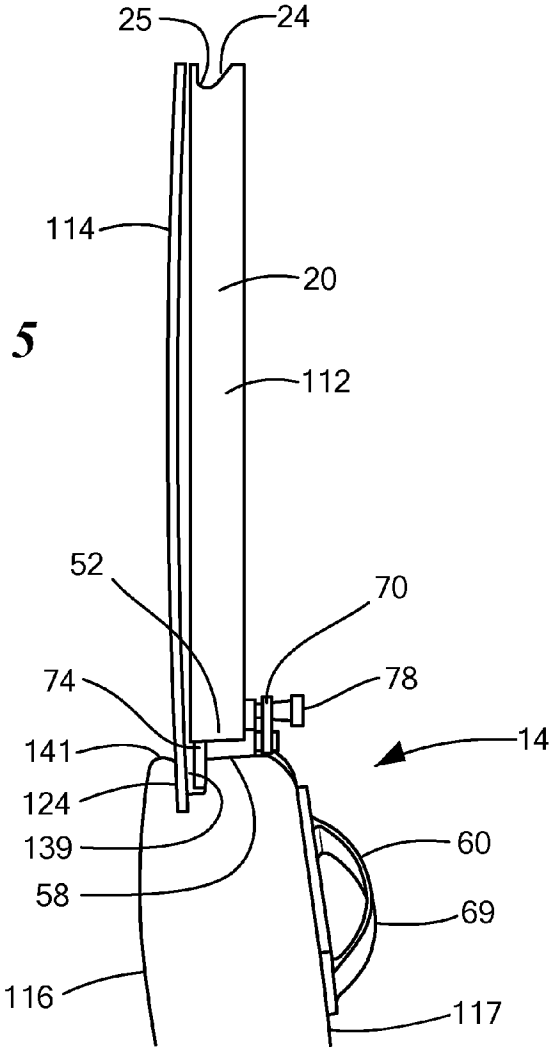
FIG. 5 is a side view of the window assembly of FIG. 1 installed in a vehicle door.
Figure 7:
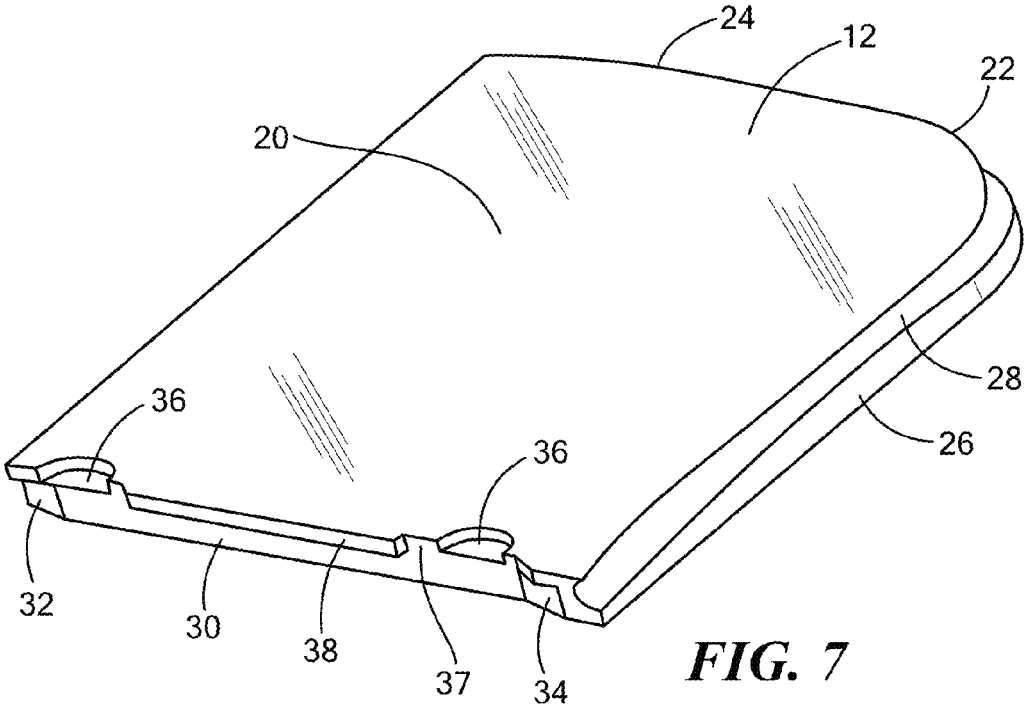
FIG. 7 is a lower isometric view of the window insert of FIG. 1.
Figure 8:
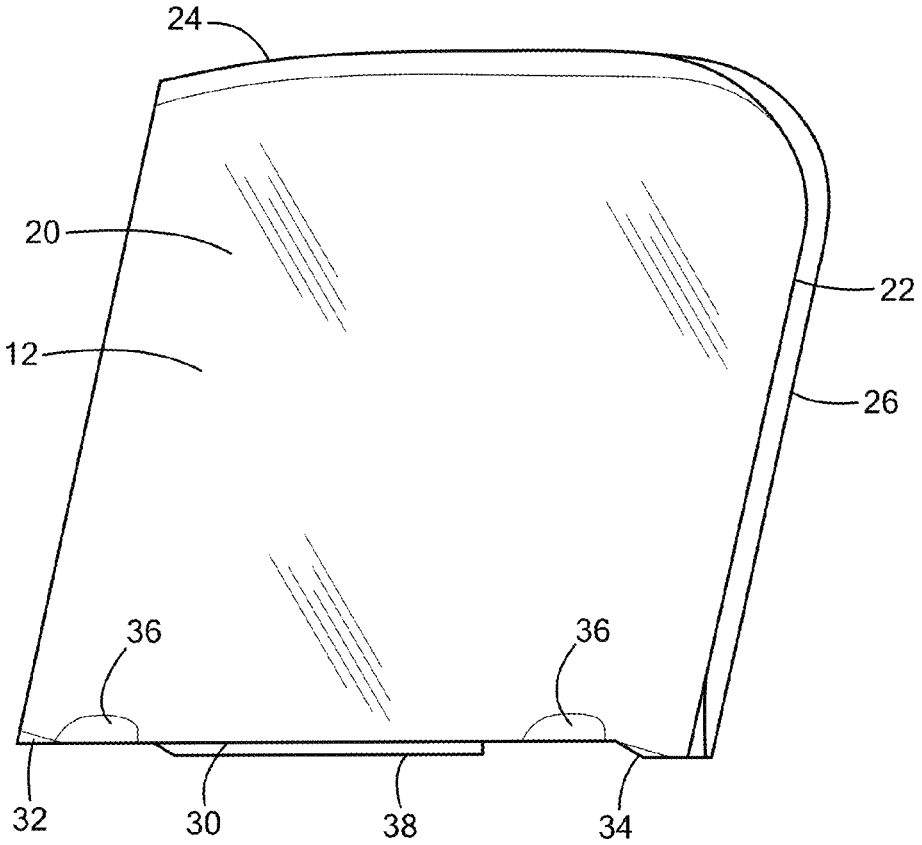
FIG. 8 is an exterior plan view of the window insert of FIG. 1.
Figure 10:
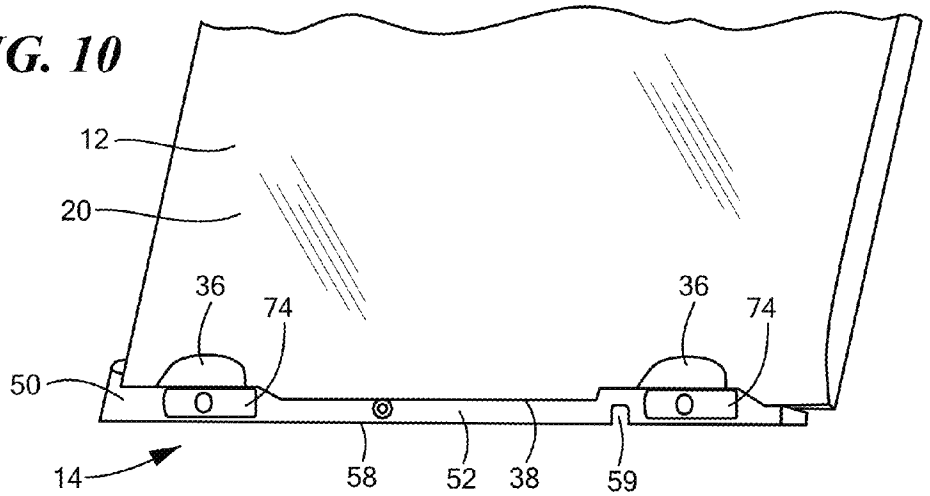
FIG. 10 is a partial exterior view of the window insert assembly of FIG. 1 with a latching mechanism in an unlatched position.
Figure 11:
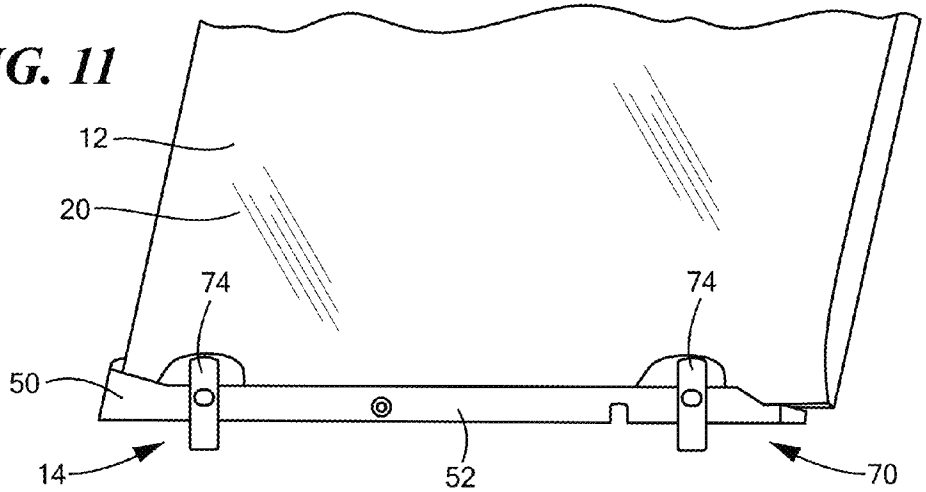
FIG. 11 is a partial exterior view of the window insert assembly of FIG. 1 with a latching mechanism in a latched position.
Figure 9:
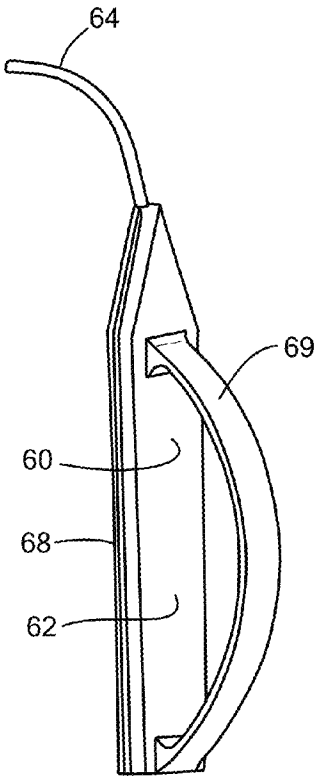
FIG. 9 is an isometric view of a securing strap of the window insert of FIG. 1.
Figure 12:
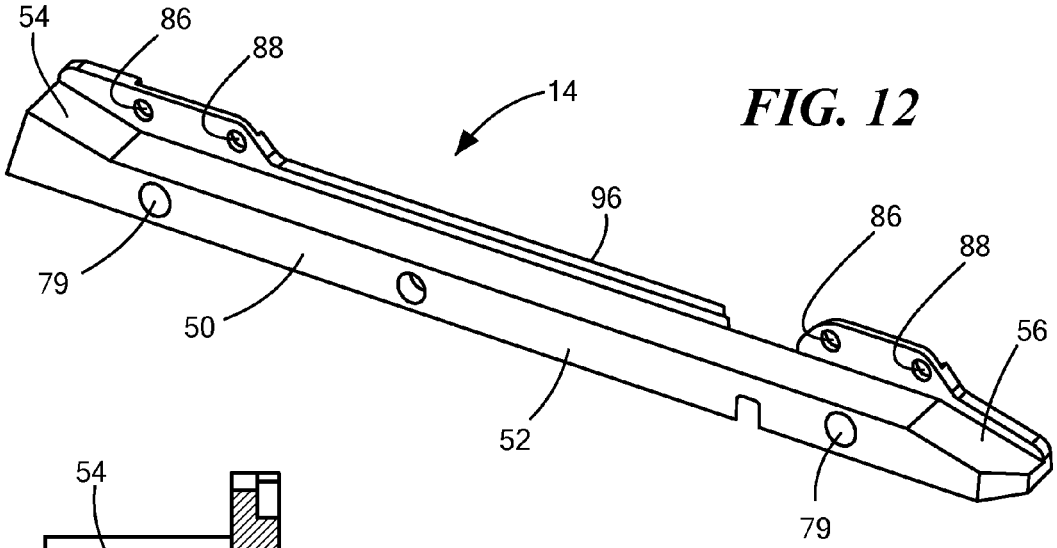
FIG. 12 is an isometric view of a wedge assembly of the window insert assembly of FIG. 1.
Figure 14:
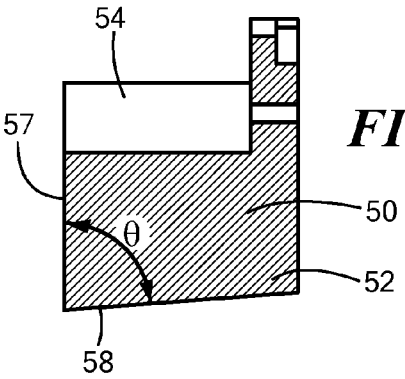
FIG. 14 is a cross-sectional view of the wedge assembly of FIG. 12.
Figure 13:
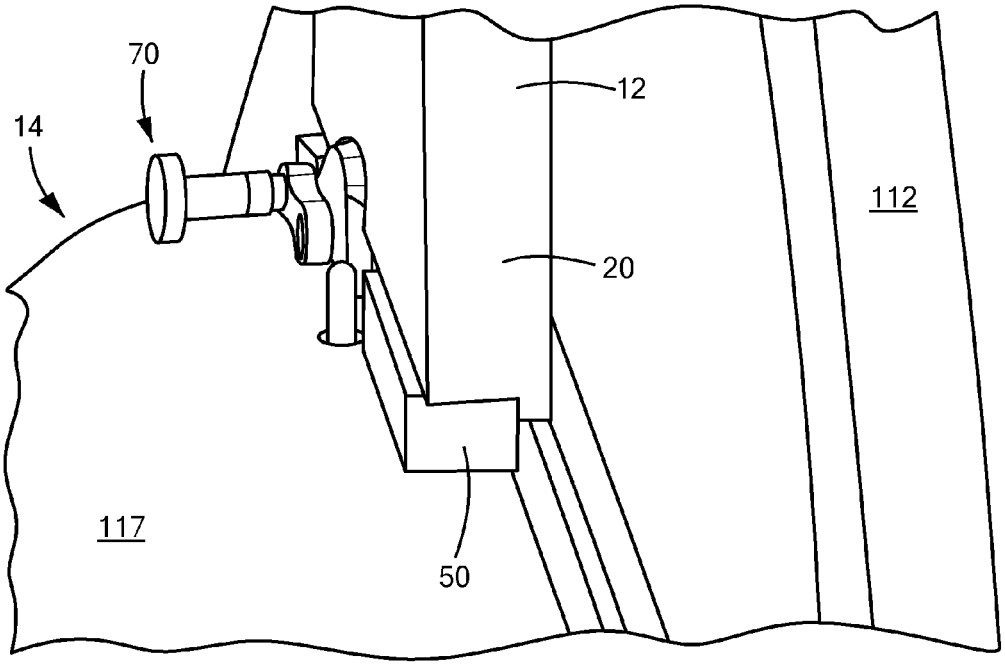
FIG. 13 is a further isometric view of the wedge assembly of FIG. 12, showing a single latch assembly for clarity.
Figure 15:
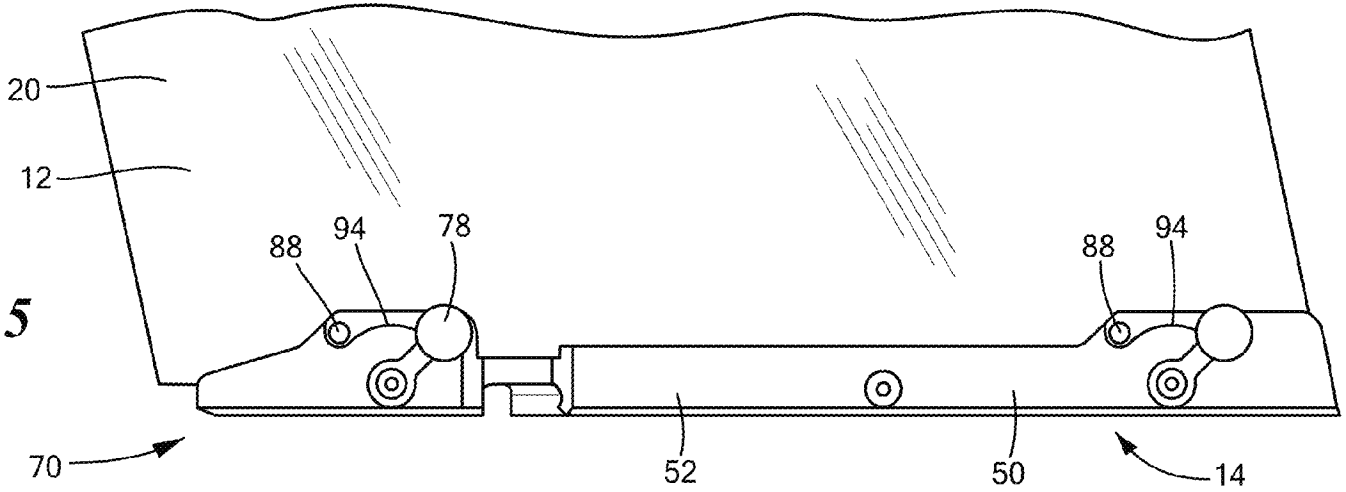
FIG. 15 is a partial interior view of the window insert assembly of FIG. 1 with a latching mechanism in an unlatched position.
Figure 16:
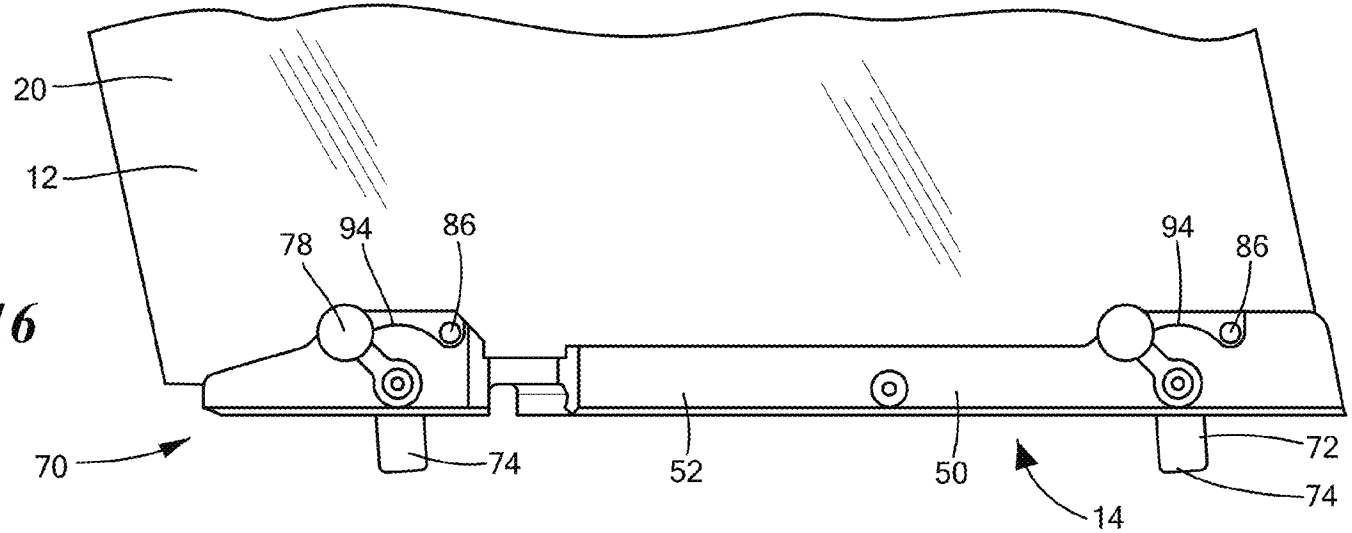
FIG. 16 is a partial interior view of the window insert assembly of FIG. 1 with a latching mechanism in a latched position.
Figure 17:
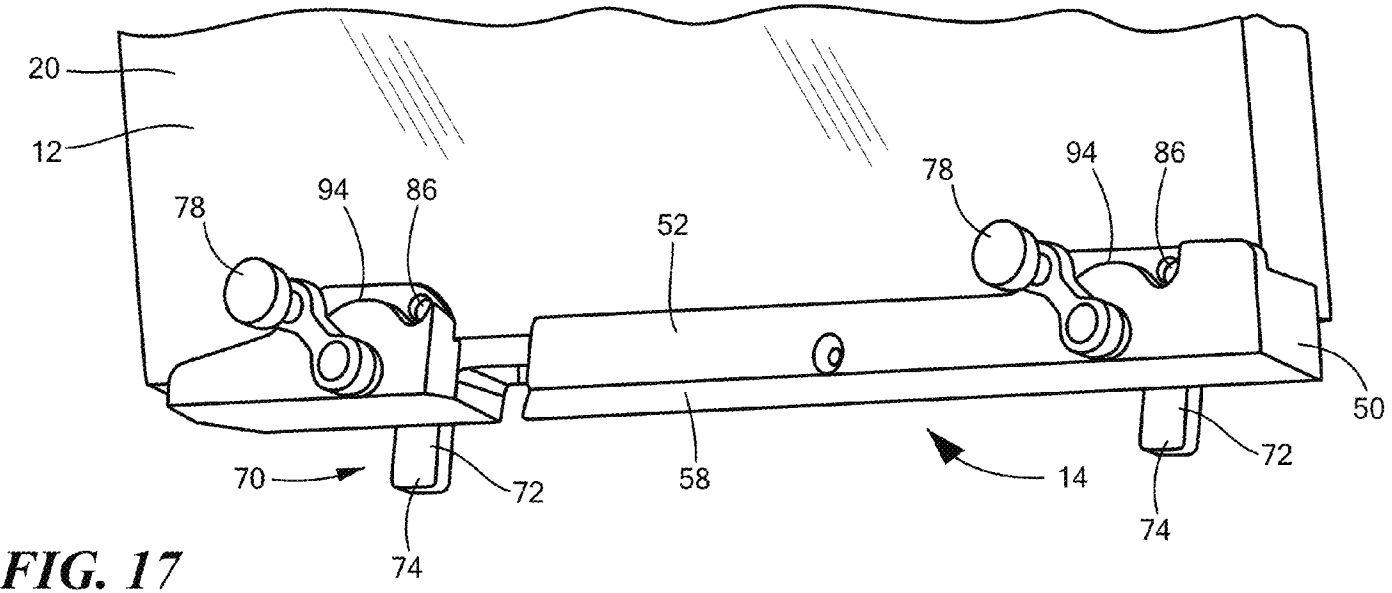
FIG. 17 is a partial isometric interior view of the window insert assembly of FIG. 1 with a latching mechanism in a position.
Figure 18:
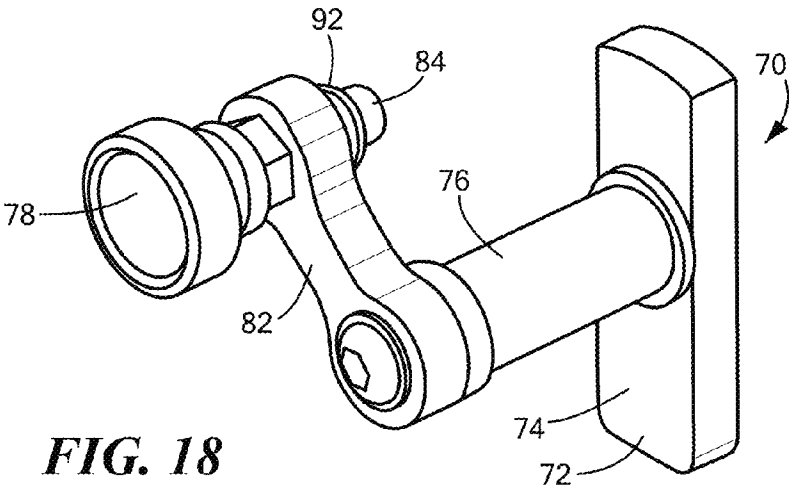
FIG. 18 is an isometric view of an actuator for the latching mechanism of the window insert assembly of FIG. 1.
Figure 20:
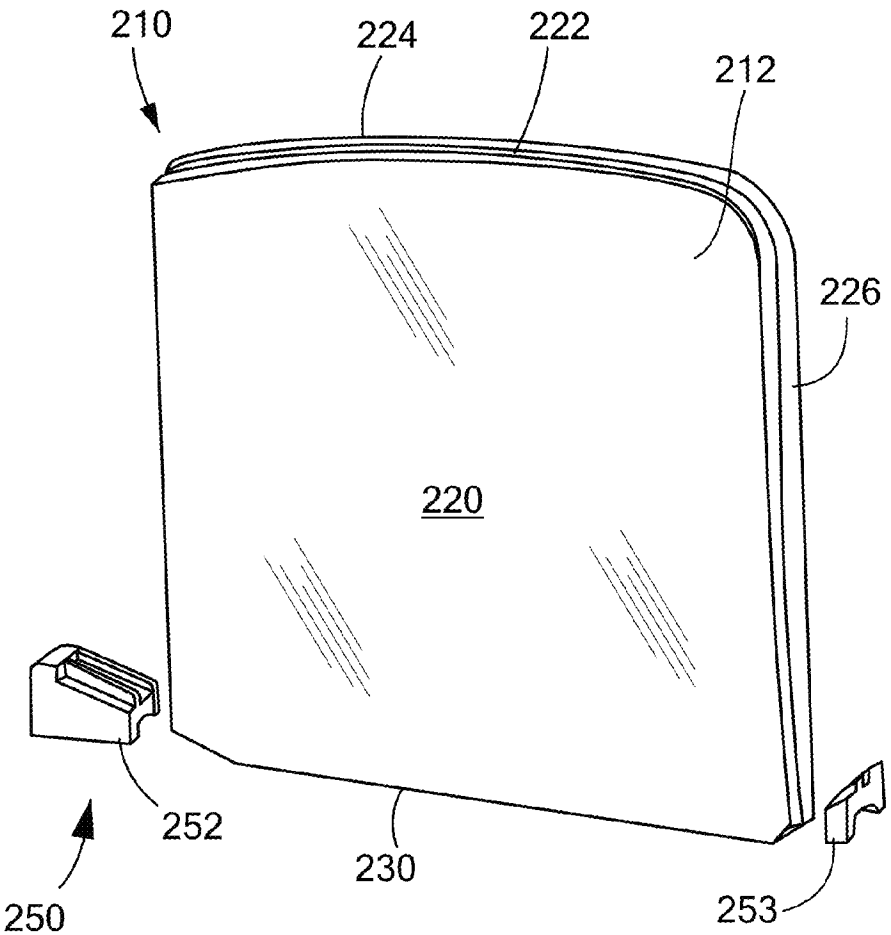
FIG. 20 is an exploded isometric view of the window insert assembly of FIG. 19.
Figure 19:
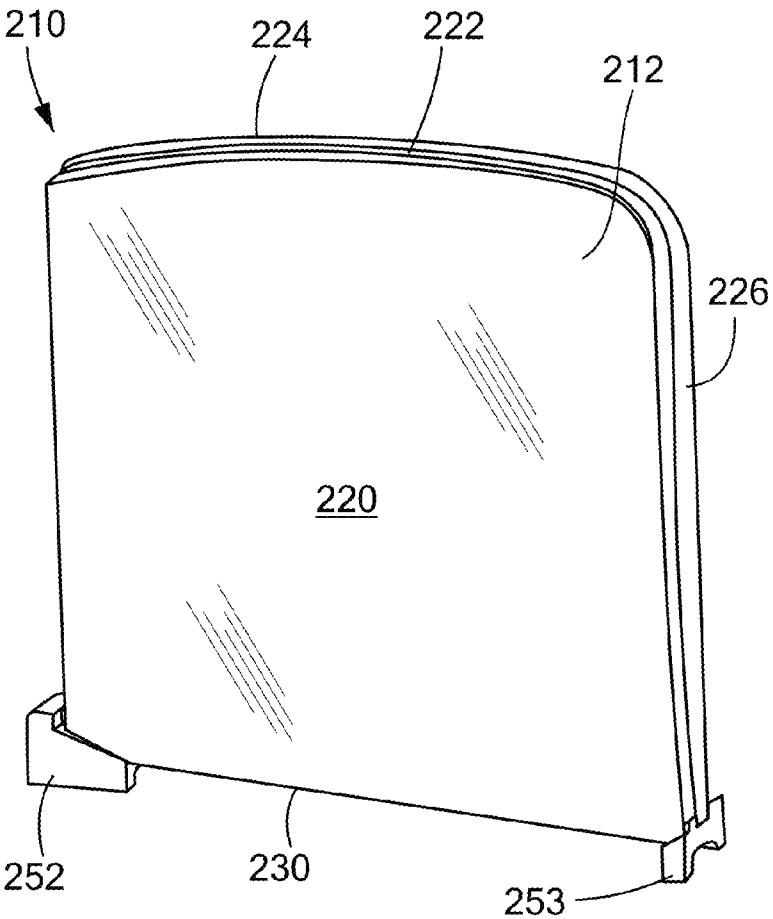
FIG. 19 is an isometric view of a further embodiment of a window insert assembly.
Figure 21:
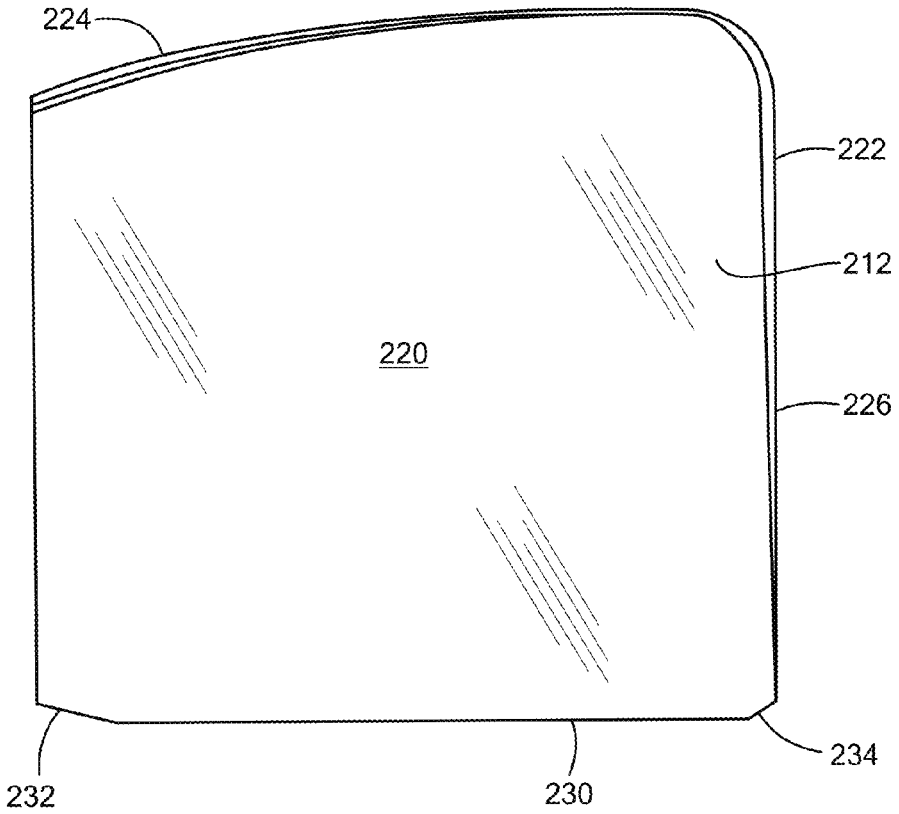
FIG. 21 is a plan view of the window insert of FIG. 19.
Figure 22:
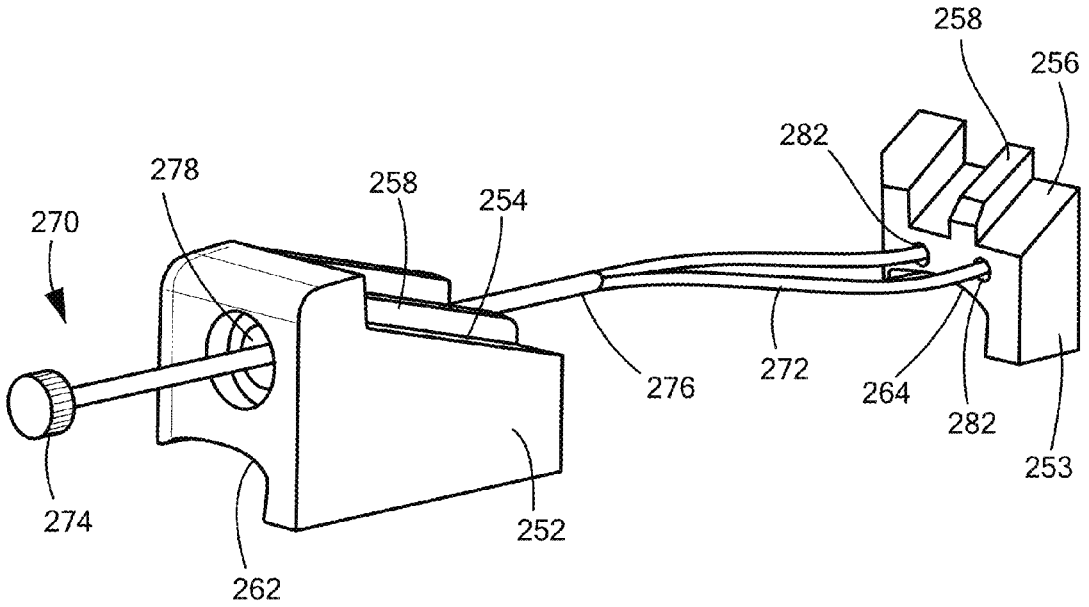
FIG. 22 is an isometric view of the wedge assembly of the window insert assembly of FIG. 19.
Figure 23:
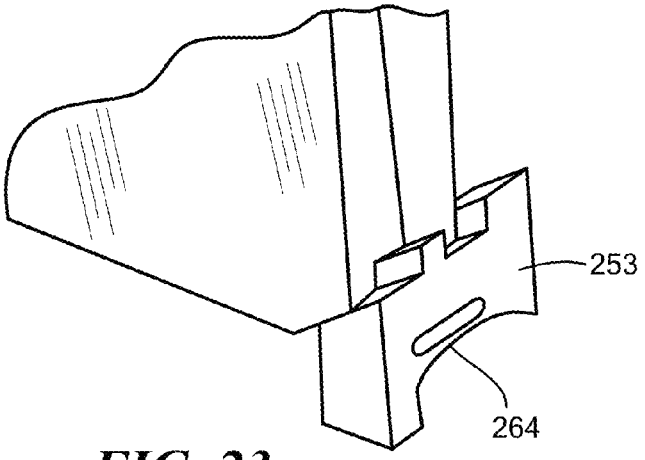
FIG. 23 is a partial view of the window insert assembly of FIG. 19.
Figure 25:
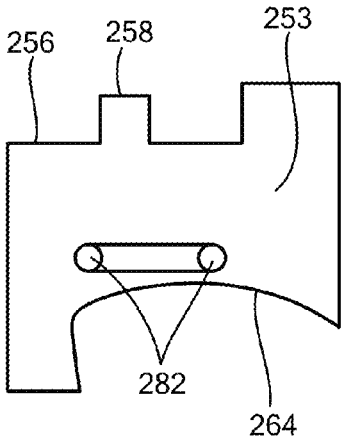
FIG. 25 is an end view of a portion of the wedge assembly of the window insert assembly of FIG. 19.
Figure 24:
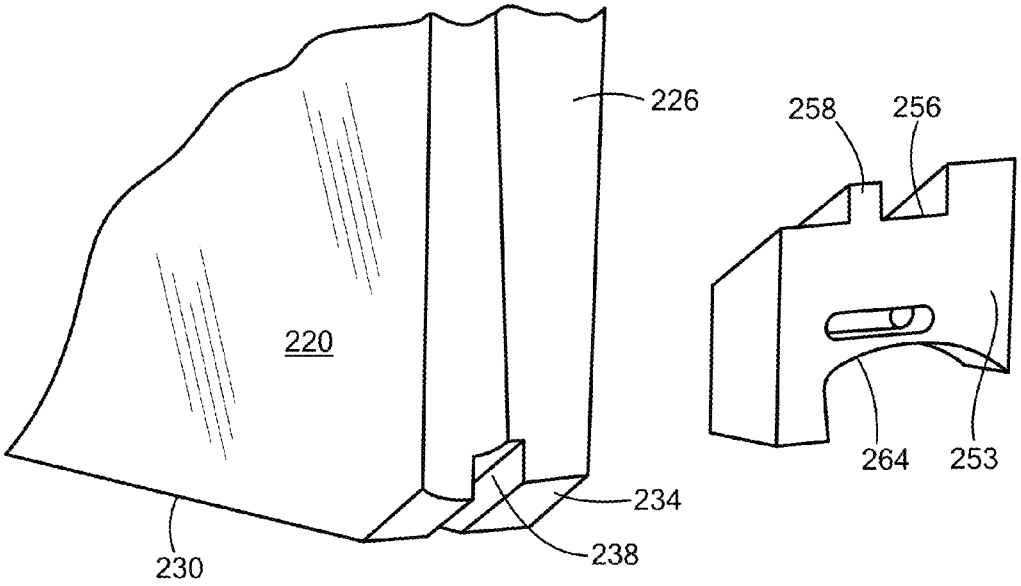
FIG. 24 is a partial exploded view of FIG. 23.

A typical vehicle side door 110 includes an exterior door panel 116 and an interior door panel 117. Various components, such as a door latching mechanism, the window mechanism, handles, and switches are typically housed within or mounted to the door panels. The window frame 112 extends above the door panels to support the stock window 114 in a window opening 118. In the closed position, edges of the stock window fit within grooves 122 formed along the window frame. See FIG. 3. When it is desired to open the window, the window can be retracted downwardly through a window retraction slot 124, a lengthwise opening between the interior and exterior door panels, into a receptacle between the door panels.

Most window frames include a shallow contoured edge 126 that extends along an upper edge 132 of the window frame on the interior side 128. See FIG. 3. Similarly, most window frames have a rear edge member 134 with a contoured edge 136 aligned adjacent the vehicle's B pillar 138. Most vehicle side door panels have a channel 139 along the lower edge 141 of the window frame (or the upper edge of the door panel) adjacent the retraction slot 124 of the window receptacle on the interior side. The present window insert assembly 10 utilizes one or more of these contours of the window frame to enable the attachment assembly 14 to force the window insert 12 upwardly and/or rearwardly against the window frame 112. As used herein, the terms "front" and "rear" and variations thereof are relative to the front and rear of the vehicle. That is, the direction "rearward" is toward the rear of the vehicle.

One embodiment of a window insert assembly 10 for a vehicle side door is shown in FIGS. 1-18. The window insert assembly includes a window insert 12 comprising a panel or sheet 20 of a ballistic-resistant material and an attachment assembly 14 comprising a wedge assembly 50. A perimeter 22 of the window insert 12 includes an upper edge 24 that can be contoured, for example, with a concave groove 25, to fit the contoured upper edge of the vehicle window frame. See FIG. 3. The fit does not have to be fully complementary; that is, there can be a gap or gaps between parts of the upper edge of the window insert and the upper edge of the window frame. A rear edge 26 of the insert's perimeter 22 can be similarly contoured, for example, with a concave groove 28, to fit against the rear of the window frame. The fit also does not have to be fully complementary; that is, there can be a gap or gaps between parts of the rear edge of the window insert and the rear edge of the window frame. The groove 25 can be continuous with the groove 28. The contour of the upper edge 24 and rear edge 26 can be selected depending on the particular contour of the window frame, which can vary from vehicle to vehicle. A lower edge or bottom 30 of the insert's perimeter 22 includes at least one wedge surface 32 that cooperates with the wedge assembly 50 to force the insert 12 upwardly and/or rearwardly against the window frame 112, described further below. In the embodiment shown, the lower edge 30 includes a front wedge surface 32 and a rear wedge surface 34. The wedge surfaces are parallel to each other or at the same angle relative to the lower edge. The wedge surfaces slope downwardly toward the rear of the vehicle. In some embodiments, the angle of the wedge surfaces can range from 5° to 20° from horizontal. The angle can be dependent on the door frame geometry, which can vary from vehicle to vehicle. The lower edge can also include a recess 37 to provide clearance for a door lock button. In the embodiment shown, the window insert does not cover the entire area of the stock window, but can leave a front area 142 uncovered. (It will be appreciated that the stock window 114 covers this front area when raised to the closed position.)

In the embodiment of FIGS. 1-18, the wedge assembly 50 includes a wedge body 52 having a complementary wedge surfaces(s) to cooperate with the wedge surface(s) of the window insert. In the embodiment, shown, a front wedge surface 54 and a rear wedge surface 56 are provided. The wedge assembly includes a bottom edge 58 that rests on the upper edge 141 of the door panel (or lower edge of the window frame). In some embodiments, the bottom edge can be contoured to fit the upper edge 141 of the door panel. In some embodiments, the bottom edge of the wedge body can be flat. In some embodiments that bottom edge 58 can be at an angle θ of 90°±10° to a vertical wall 57 of the wedge body (see FIG. 14), for example, to match a particular door frame. In some embodiments, the bottom edge can include a recess 59 aligned with the recess 37 on the window insert to provide clearance for the door lock button. The front wedge surface 54 is disposed to abut against and slide along the front wedge surface 32 of the window insert 12. Similarly, the rear wedge surface 56 is disposed to abut against and slide along the rear wedge surface 34 of the window insert. The front wedge surfaces 32, 54 are higher than the rear wedge surfaces 34, 56 to enable the wedge body 52 to access both wedge surfaces when inserted below the window insert from the front toward the rear. During installation, the wedge assembly 50 is placed beneath the window insert 12 and moved in a rearward direction. The wedge surfaces 54, 56 of the wedge body 52 push upwardly on the wedge surfaces 32, 34 of the window insert 12, thereby moving the window insert upwardly to engage the upper edge 132 of the vehicle frame. The wedge body 52 also moves the window insert rearwardly toward the rear 134 of the window frame 114. The wedge body 52 is then secured in place with a securing mechanism 60 to thereby retain the window insert 12 in place. The wedge body 52 also covers the gap between the bottom 30 of the window insert and the upper edge of the door fame, providing additional protection for an occupant of the vehicle.

Any suitable securing mechanism 60 can be provided to move the wedge assembly 50 in the rearward direction and fasten it in place. In some embodiments, the securing mechanism can be a securing strap 62 attached under tension between the wedge body 52 and the inner door panel. The securing strap can be secured under tension to the inner door panel in any suitable manner that allows a force component to be exerted on the wedge assembly to pull the wedge assembly in the rearward direction and hold it there. In some embodiments, the strap can be attached to the wedge body at, for example, an intermediate location between the front wedge surface and the rear wedge surface. In some embodiments, the securing strap can include a cable 64 that is fastened through an opening 66 in the wedge body 52, for example, with a knot or other widened element on the end. The knot can be enclosed with a recess in the wedge body. In some embodiments, the cable can be a nylon rope having a ¼ inch to 5/16 inch diameter nominal. In some embodiments, the securing strap can include a rigid hook that fits through the opening 66. In some embodiments, the securing strap can be fastened to the inner door panel with a hook and loop fastener in which one 68 of the hooks and the loops is disposed on the strap 62 and the other of the hooks and the loops is disposed on a surface of the inner door panel 117. A heavy duty hook and loop fastener available from 3M attached to the door with a VHB adhesive from 3M over an area about 2 inches by 3 inches is suitable. In some embodiments, the strap can include a handle 69 to assist in attaching the strap under tension to the door. Other mechanisms to attach the securing strap to the inner door panel can be provided, such as hooks or latches.

In some embodiments, the securing mechanism 60 can also include a latching mechanism 70 to assist in retaining the window insert 12 and wedge assembly 50 within the window and to assist in preventing the window insert and the wedge assembly from moving inwardly into the vehicle if struck by a high velocity projectile from outside the vehicle. In some embodiments, the latching mechanism can include one or more retractable latches 72 that fit within the window retraction slot 124. Two latches are shown, although any desired number can be provided. The retractable latches 72 can be located on the wedge assembly 50 to engage the window retraction slot inwardly of the stock window where they do not interfere with the normal operation of the vehicle stock window. In some embodiments, each latch 72 extends into the window slot in a latched position and is parallel to and outside of the window retraction slot in an unlatched position. Each latch includes a latch bar 74 mounted on a rotatable axle 76 that extends through an opening 79 in the body 52 of the wedge assembly. The latch bar 74 can be rotated between the horizontal unlatched position (FIGS. 10, 15) and the vertical latched position (FIGS. 11, 16, 17) in which an end of the latch bar protrudes downwardly into the window retraction slot. Rotation of the axle and latch bar is effected by a knob 78 attached to a lever arm 82 on an opposite end of the axle, accessible by a user from the inside of the door. The user can grasp the knob to rotate the axle and thereby the latch bar. The window insert 12 can include a recessed area 36 to provide clearance for the latch bar. The knob also includes a retractable locking pin 84 extending through the end of the arm for insertion into one of two positions, defined by openings 86, 88 on the wedge body 52 into which the pin can fit. When the locking pin is in the opening 88, the latch bar is retained in the vertical latched position; when the locking pin is in the other opening 86, the latch bar is retained in the horizontal unlatched position. The locking pin can be biased, for example, by a spring 92, toward the openings. To remove the pin from an opening, the user pulls backwardly on the knob against the bias of the spring. A curved surface 94 on the wedge body 52 extends between the two openings to guide rotation of the latch mechanism between the latched and the unlatched positions.

In some embodiments, the wedge assembly can also include a lip or lips 96 upstanding from an upper surface, and the window insert can include one or more depending flanges 38 along the lower edge that rest against the upper surface of the wedge assembly. The flange(s) also can abut against the upstanding lip(s) of the wedge assembly. This abutment further assists in keeping the window insert from moving inwardly.

The strap 62 of the securing mechanism 60 also holds the wedge assembly 50 and the window insert 12 inwardly, pulling the latch bars 74 against the inside of the window retraction slot 124, so that the stock window 114 can operate normally without interference from the window insert assembly. For example, slamming the door could cause the window insert 12 and the wedge assembly 50 to shift and move to a position in which the latch bars 74 could interfere with the stock window operation. The strap prevents this.

In one embodiment, installation is as follows: The vehicle stock window 114 is opened, and the window insert 12 and wedge assembly 50 are placed in the window opening 118 as far rearward, toward the B pillar, as possible, keeping the groove 26 of the window insert aligned within the contoured upper edge 126 of the window frame 112. The wedge assembly 50 is pulled toward the rear using the securing assembly 60, pushing the window insert upwardly against the upper edge of the door frame, and fastened in place, for example, by pressing the hook and loop fastener together. The window insert and wedge body can be inserted into the window opening at a position close to the final position. Securing the wedge body to the door requires a minimal amount of sliding motion necessary to engage the wedge surfaces on the widow insert and lock the insert in position. In some embodiments, the sliding motion is less than 1.0 inch; in some embodiments, the sliding motion is less than 0.5 inch. The latching mechanism 70 is then actuated to engage the latches 72 with the window retraction slot 124. Once the window insert is locked into place, the vehicle stock window can be operated normally. FIG. 1 illustrates a vehicle door with the window insert 12 in place and the vehicle stock window 114 (shown in phantom) partially opened.

The wedge assembly 50 can also allow easy and fast egress from the vehicle through the window opening in an emergency event in which opening the door is precluded. The latches 72 can be quickly released and the window insert 12 pushed to the outside.

Other securing mechanisms to hold the window insert inwardly (to avoid interference with the stock window) and rearwardly and/or upwardly can be provided. In some embodiments, the directions of force application can be divided between separate devices. For example, in some embodiments, a spring-loaded compression strut can be placed between the window insert and the forward edge of the window frame to push the insert rearwardly, and a mechanical latch can be attached to the inner door frame and the insert to hold the wedge assembly inwardly. In some embodiments, a compression strut can be fixed within the retraction slot and oriented to exert a compressive force on the bottom of the window insert to push the insert upwardly. In some embodiments, cables can be employed to exert a tensile force in a desired direction.

A further embodiment of a window insert assembly 210 for a vehicle side door is shown in FIGS. 19-25. The window insert assembly includes a window insert 212 comprising a sheet 220 of a ballistic-resistant material and having a perimeter 222 contoured along its upper edge 224 and rear edge 226 as described above. A lower edge 230 of the insert perimeter includes a front wedge surface 232 and a rear wedge surface 234. The wedge surfaces 232, 234 are oppositely angled.

The wedge assembly 250 includes a front wedge body 252 and a rear wedge body 253. The front wedge body 252 has a front wedge surface 254 complementary to and disposed to abut against the front wedge surface 232 of the window insert 212. Similarly, the rear wedge body 253 has a rear wedge surface 256 complementary to and disposed to abut against the rear wedge surface 234 of the window insert. The wedge bodies 252, 253 are pulled or otherwise moved toward each other, described further below. As they move together, the wedges push upwardly on the window insert, moving the window insert upwardly to engage the upper edge of the vehicle window frame.

In some embodiments, the rear wedge surfaces 234, 256 have a steeper angle than the front wedge surfaces 232, 254, so that the rear wedge body 253 tends to remain stationary. The shallower angle on the front wedge body 252 allows it to slide more easily. This further helps to force the window insert 212 upwardly against the upper edge 132 of the window frame 112. In one embodiment, the rear wedge surface is approximately 45° and the front wedge surface is approximately 20°, but it will be appreciated that other angles can be used.

One or both of the wedge bodies 252, 253 can also have an extension or tab 258 on its upper side to engage a complementary perimeter slot 238 (only rear wedge shown) in the window insert, along the wedge surfaces of the window insert. This allows the wedges to slide together while holding the window from moving inwardly or outwardly of the vehicle. This also assists in securing the bottom of the window insert from the action of an outside ballistic threat.

The bottom surfaces 262, 264 of one or both wedges can be contoured to fit the upper edge of the door panel (the bottom edge of the window frame) and protrude into the retraction slot, and secure the wedges from moving inwardly or outwardly from the vehicle. This also assists in securing the bottom of the window insert from the action of an outside ballistic threat.

In one embodiment, the wedge bodies are interconnected by a securing mechanism 270. The securing mechanism is operable to pull the front wedge body 252 toward the rear wedge body 253 to thereby apply an upwardly-directed compression force on the wedge surfaces of the window insert, wedging the window insert into the upper window frame while forcing the rear wedge body into the upper edge of the door panel (bottom edge of the window frame).

More particularly, the securing mechanism 270 includes a cord or string 272 that is attached under tension to the rear wedge body. A knob 274 with a shaft extension 276 extends through an opening 278 in the front wedge body and connects to the cord 272. The cord passes through holes 282 in the rear wedge body 253 and back to the front wedge body 252. Twisting the knob also twists the cord, shortening the cord and pulling the wedges together. A one-way ratchet on the knob stops it from unwinding, unless it is forced by hand. In another embodiment, the cord and knob can be replaced with a right and left handed screw connecting the front and rear wedges. A cord or string is advantageous, however, because it is flexible and conforms to shapes that a rigid element cannot do.

In one embodiment, installation is as follows: The vehicle window 114 is opened, and the window insert 210 and wedge assembly 250 are placed in the window opening 118 as far rearward, toward the B pillar, as possible, keeping the groove of the window insert aligned within the contoured upper edge of the door frame. The wedge assembly is pulled toward the rear using the securing mechanism 270, pushing the window insert upwardly against the upper edge of the door frame, and fastened in place. The rear wedge body is wedged under the rear corner of the window insert. The front wedge body is pulled toward the rear wedge body, for example, by turning the knob 274 or with a screwdriver. Once the window insert is locked into place, the vehicle window can be operated normally.

Figure 26:
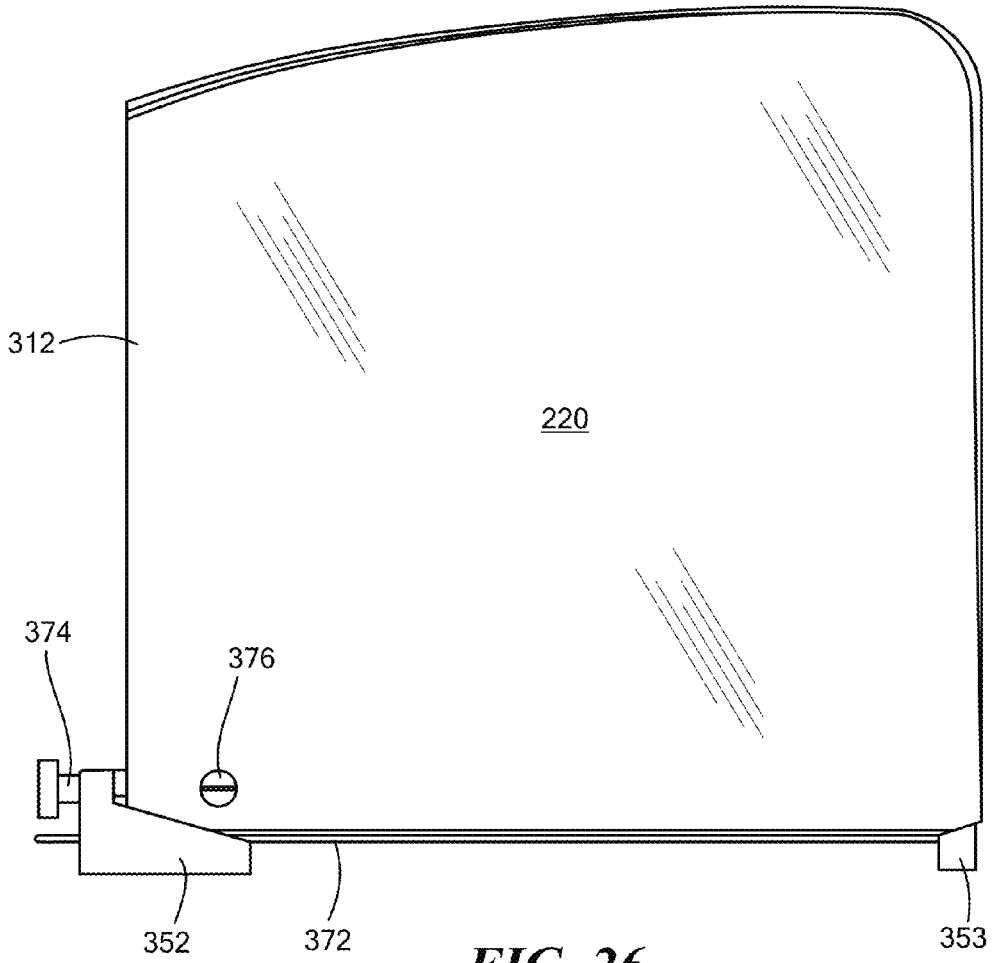
FIG. 26 is a plan view of a further embodiment of a window insert assembly.
Figure 27:
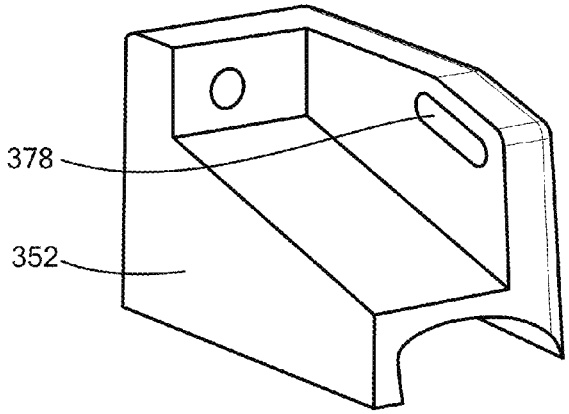
FIG. 27 is an isometric view of a portion of the wedge assembly of FIG. 26.
Figure 28:
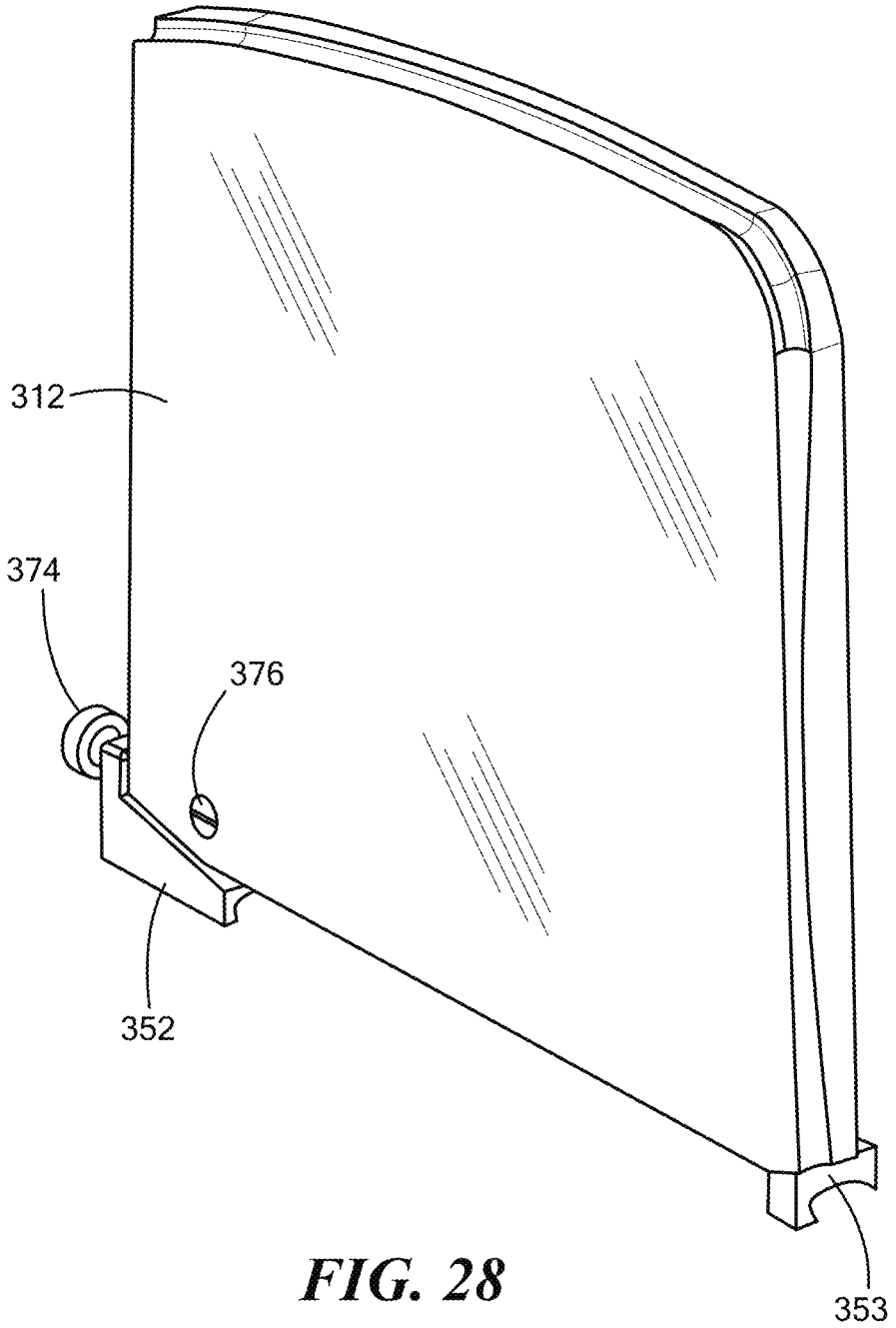
FIG. 28 is an isometric view of the window insert assembly of FIG. 26.

Other mechanisms to draw the wedge bodies together can be provided. For example, in another embodiment, illustrated in FIGS. 26-28, wedge bodies 352, 353 can be connected by a rod 372 and the front wedge body 352 can include a screw 374 that engages the window insert 312, for example, via a barrel screw 376 that fits through an aperture in the window insert and corresponding slot 378 in the front wedge body. In other embodiments, a spring mechanism, such as a spring loaded fastener, can be used. It will be appreciated that other latching mechanisms that force the window insert into a secured position can be used.

Figure 30:
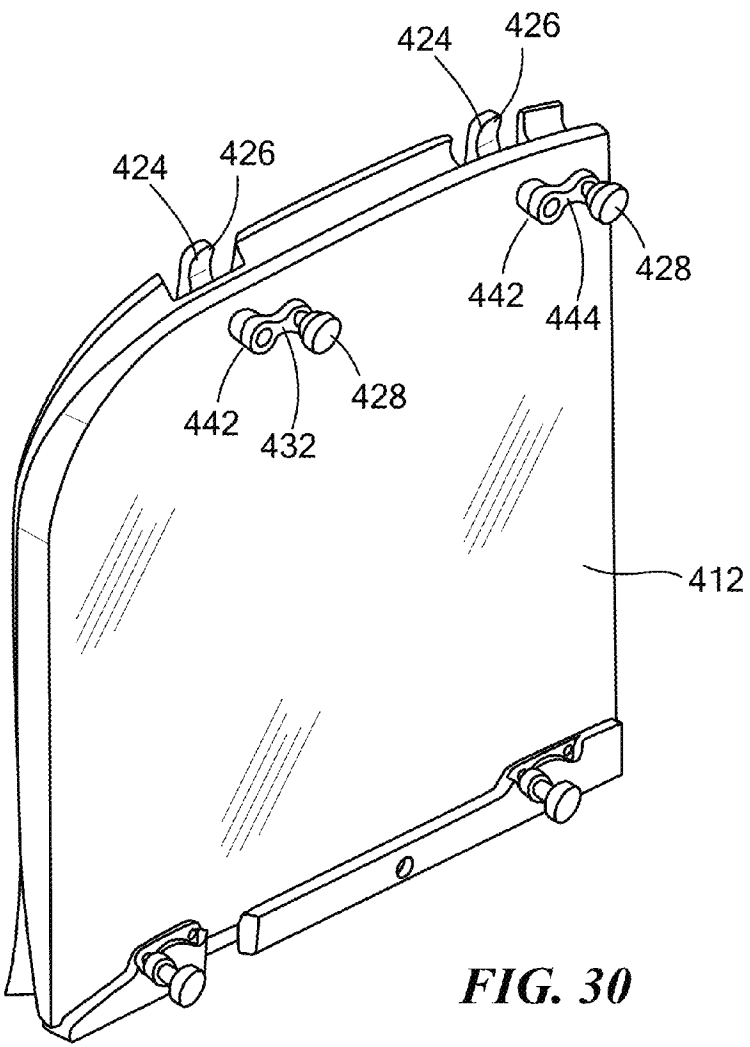
FIG. 30 is an isometric inside view of the window insert of FIG. 29.
Figure 29:
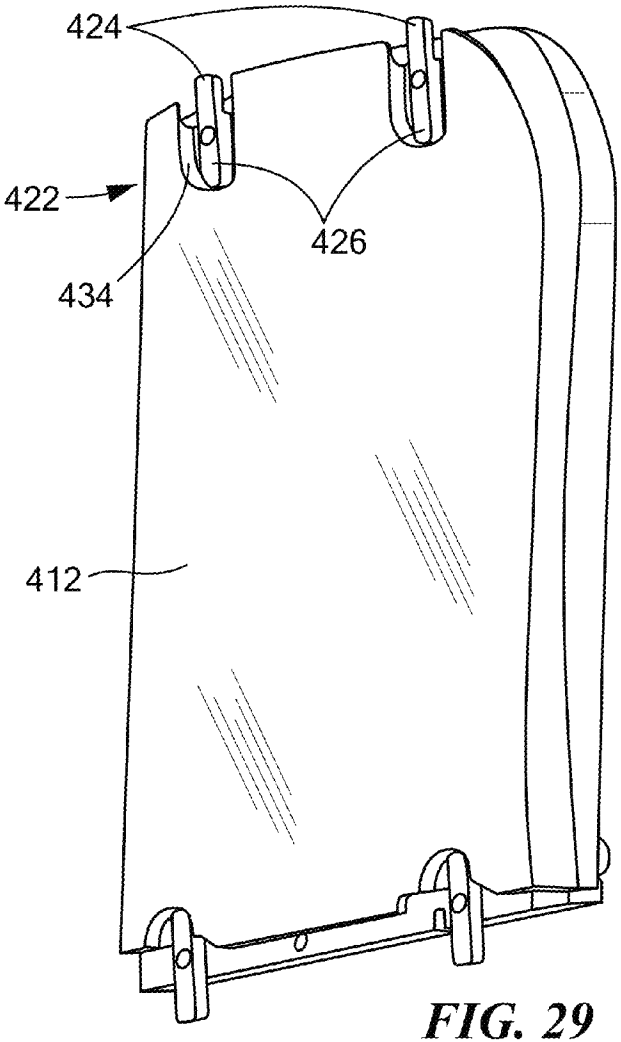
FIG. 29 is an isometric outside view of a further embodiment of a window insert assembly.
Figure 31:
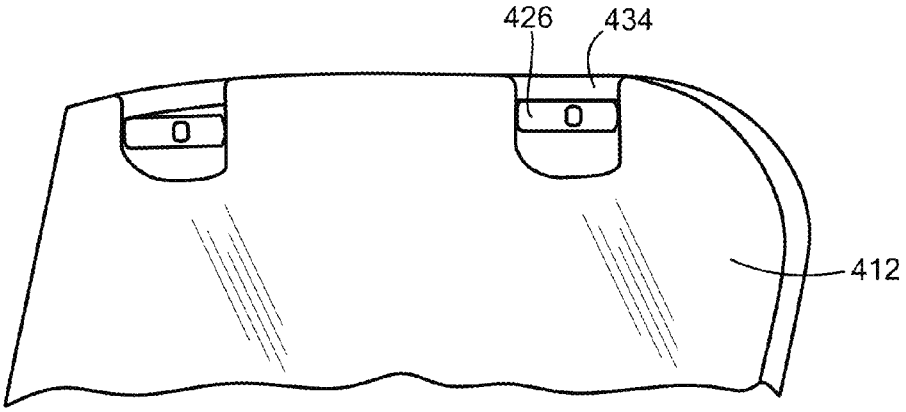
FIG. 31 is a partial plan view of the window insert of FIG. 29.

On the door window frames of some vehicle models, the concave upper edge of the window insert cannot properly engage or straddle the window frame sufficiently to support the window insert against an impact of a projectile from outside of the vehicle. The upper edge of the window insert would be too thin and not capable of adequately handling the impact load. Accordingly, in some embodiments, an additional upper latch mechanism can be provided at the top of the window insert to engage a stock window track in the upper window frame with a higher strength material. Referring to FIGS. 29-31, in some embodiments, an upper latch mechanism 422 can include one or more upper latches 424 similar to the lower latches described above. For example, each latch can include a latch bar 426 mounted on a rotatable axle that extends through an opening in the window insert 412. The latch bar can be rotated between a horizontal unlatched position (FIG. 31) and a vertical latched position (FIGS. 29-30) in which an end of the latch bar protrudes upwardly to fit into the window track (not shown). Rotation of the axle and latch bar can be effected by a knob 428 attached to a lever arm 432 on an opposite end of the axle, accessible by a user from the inside of the door. The user can grasp the knob to rotate the axle and thereby the latch bar. The window insert can include a recessed area 434 to provide clearance for the latch bar. The knob can also include a retractable locking pin (not visible in the figures) extending through the end of the arm for insertion into one of two positions, defined by openings on the window insert (only opening 442 is visible) into which the pin can fit, as described above. The locking pin can be biased, for example, by a spring 444, toward the openings. To remove the pin from an opening, the user can pull backwardly on the knob against the bias of the spring. Two latches are shown; it will be appreciated that any other number, including one latch, could be used, depending on the window frame design and application requirements.

Because the window insert is generally moved upwardly to engage the window frame during installation, in some embodiments, the upper latch bar can be fixed in the engaged, vertical position, eliminating a need for actuating hardware. The latches can be bolted or otherwise affixed to the window insert.

In some embodiments, the window insert assembly can be attached within the window frame of the vehicle door on an exterior side of the stock window of the vehicle door, for example, if necessitated by a particular vehicle door geometry.

The window insert can be made from a transparent armor ballistic material. Typical materials for Level 3A protection include acrylic, glass, polycarbonate, ceramic, and combinations thereof. The material(s) can be formed as a lamination. Thicknesses can range from approximately 0.75 inch to 2.0 inches, although greater or lesser thicknesses could be used. In some embodiments, a window insert made of a polycarbonate material can be about 1.25 inches thick. Areal densities can range from about 6.0 to 10.0 $lb/ft^2$ for a polycarbonate window insert. Greater protection levels can be achieved with glass or transparent ceramic/acrylic or ceramic/polycarbonate laminates with the same approximate thickness, but having a higher areal density.

In some embodiments, the window insert can provide ballistic protection to NIJ Level 3A (NIJ 0108.01). This level protects against handgun ammunition to 0.44 caliber magnum. Higher levels, such as NIJ Level 3 or NIJ Level 4, can be achieved with transparent glass/acrylic laminates having a greater areal density. In some embodiments, the window insert can provide ballistic protection against shotgun projectiles.

The wedge assembly can be made from a metal or metal alloy, such as aluminum, or any other suitable strong material.

Figure 32:
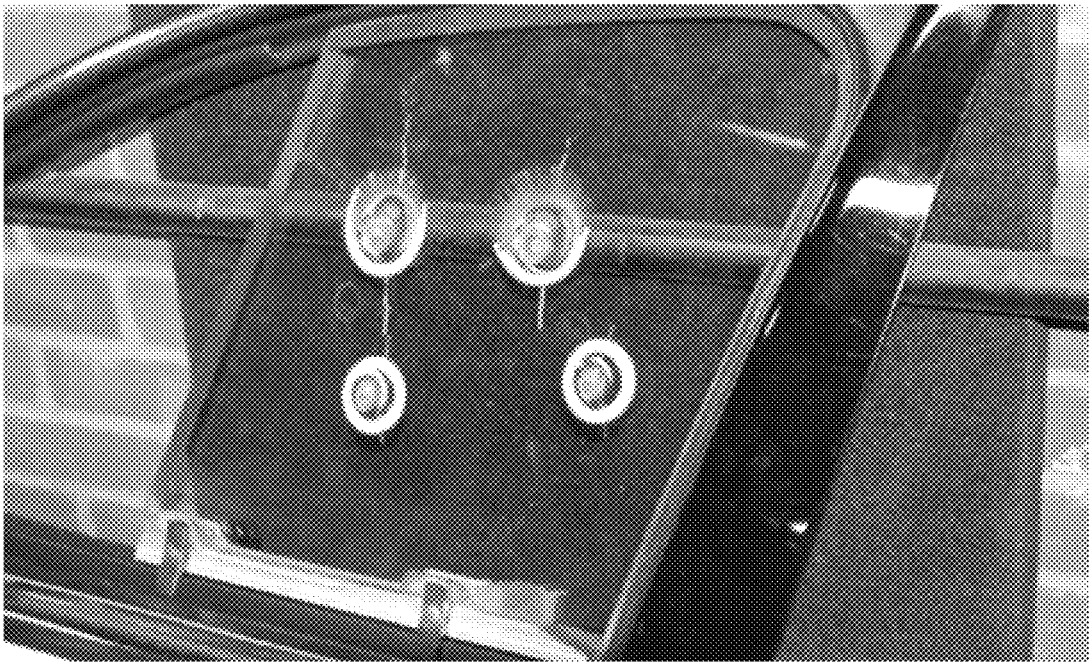
FIG. 32 is a photograph of test results of a window insert assembly.

A window insert assembly according to the embodiment illustrated in FIGS. 1-18 was tested against projectile impacts. The window insert assembly was installed within a vehicle door as described herein. Two test rounds using 12 gauge slugs fired from a shotgun and two test rounds using 0.44 caliber magnum cartridges fired from a handgun were fired at the window insert from a distance of approximately 10 to 15 feet. FIG. 32 is a photograph of the results of the test, illustrating that the window insert assembly remained intact within the window frame and prevented the projectiles from penetrating the window insert. In FIG. 32, the top two impact markings were from the two shotgun rounds and the two bottom impact markings were from the two handgun rounds.

Vehicle doors come in a great variety of sizes and configurations. It will be appreciated that the window insert assembly described herein can be configured to fit within any window opening in any vehicle side door.

The window insert can be manufactured in any suitable manner. In some embodiments, the window insert can be machined from a suitable piece of material using subtractive machining process and metrology techniques. In some embodiments, a metrology-grade three-dimensional scanner, which can be portable or handheld, can be used to scan the shape of the vehicle door and generate a model, from which a data file can be generated for the shape of the window insert. In some embodiments, a 3-axis milling machine can be used to cut the wedge shapes and the window insert. The window insert can also include a cut away region to provide clearance for a door lock button. In some embodiments, the window insert can be made by molding or casting.

In some embodiments, the window insert can be made using various additive manufacturing processes, such as stereolithography, fused deposition, and the like, in which a product is fabricated layer by layer. For example, a three-dimensional design of the product can be generated, for example, using any suitable computer aided design system or from a scan of the product. The three-dimensional data can be converted into a stereolithographic or STL file or other suitable file format that can be further processed to produce a data file of two-dimensional slices suitable for use by an additive manufacturing device to generate a three-dimensional object layer by layer.

The window insert does not interfere with door and window hardware, handles, or locks. The window insert does not require replacement of door hinges or any other hardware of the vehicle.

The window insert provides protection for the head and neck of the person sitting in the adjacent seat. This area of protection also covers a blind spot from which a perpetrator could approach the vehicle from the rear.

The window insert allows for normal operation of the vehicle window. The insert blocks a portion, such as about half, of the area of the window. Thus, a person inside the vehicle can open the window to, for example, hand something to another person outside the vehicle, pay a toll, or the like.

The window insert can be installed easily and quickly. In many instances, installation takes less than 5 minutes. Installation does not require specially trained personnel or special tools.

The window insert has been illustrated in conjunction with the window of the front driver side of a vehicle. It will be appreciated that the window insert can be configured to fit within the window of the front passenger side door of a vehicle. Similarly, the window insert can be configured to fit within a window adjacent a rear seat of a vehicle, either on the driver's side or the passenger's side.

The window insert is typically transparent, particularly if used in windows through which the driver must be able see. If desired, in some embodiments, such as inserts for a back seat window, the insert could be translucent or opaque. In other embodiments, the window insert could be one-way, such that occupants within the vehicle can see out, but people outside the vehicle cannot see in.

Further aspects of the invention include the following:

1. A window insert assembly for a vehicle door comprising:

a window insert comprising a sheet of a ballistic-resistant material having a perimeter, the perimeter including an upper edge, a rear edge, and a lower edge, at least one of the upper edge and the rear edge including a contour to mate with a window frame of the vehicle door; and an attachment assembly configured to attach the window insert within the window frame of the vehicle door proximate a stock window of the vehicle door.

2. The window insert assembly of item 1, wherein the attachment assembly is configured to force the window insert upwardly against an upper edge of the window frame.

3. The window insert assembly of item 2, wherein the attachment assembly is further configured to force the window insert rearwardly against a rear edge of the window frame.

4. The window insert assembly of item 1, wherein the attachment assembly is configured to force the window insert rearwardly against a rear edge of the window frame.

5. The window insert assembly of any of items 1-4, wherein the attachment assembly is configured to apply a force on the window insert within the window frame, the force having an upward component, a rearward component, or both an upward component and a rearward component.

6. The window insert assembly of any of items 1-5, wherein the attachment assembly is configured to apply a force on the window insert within the window frame directed inwardly of the vehicle to prevent the window insert assembly from interfering with operation of the stock window of the vehicle door.

7. The window insert assembly of any of items 1-6, wherein the upper edge of the perimeter is concavely contoured to generally fit an upper edge of the vehicle door window frame.

8. The window insert assembly of item 7, wherein the rear edge of the perimeter is further concavely contoured to generally fit a rear edge of the vehicle door window frame.

9. The window insert assembly of any of items 1-7, wherein the rear edge of the perimeter is concavely contoured to generally fit a rear edge of the vehicle door window frame.

10. The window insert assembly of any of items 1-9, wherein the attachment assembly is configured to attach the window insert within the window frame of the vehicle door on an interior side of the stock window of the vehicle door.

11. The window insert assembly of any of items 1-10, wherein the lower edge of the window insert includes a wedge surface; and the attachment assembly comprises a wedge assembly including a complementary wedge surface disposed to slidingly abut against the wedge surface of the window insert, and a securing mechanism operable to secure the wedge assembly in a position to exert a force on the window insert within the window frame, the force having an upward component, a rearward component, or both an upward component and a rearward component.

12. The window insert assembly of item 11, wherein the lower edge of the window insert includes a further wedge surface parallel to the wedge surface, and the wedge assembly further includes a further complementary wedge surface disposed to slidingly abut against the further wedge surface.

13. The window insert assembly of item 12, wherein the wedge assembly comprises a wedge body extendable beneath the lower edge of the window insert, the complementary wedge surface disposed at a front of the wedge body and the further complementary wedge surface disposed at a rear of the wedge body.

14. The window insert assembly of item 13, further comprising a flange upstanding from the wedge body, and a lip depending from the lower edge of the window inset to abut against the upstanding flange to prevent the window insert assembly from moving inwardly into an interior of the vehicle.

15. The window insert assembly of any of items 11-14, wherein the securing mechanism comprises a securing strap attached under tension between the wedge assembly and an inner surface of the vehicle door.

16. The window insert assembly of item 15, wherein the securing strap is attached to the inner surface of the vehicle door with a hook and loop fastener.

17. The window insert assembly of any of items 11-16, wherein the securing mechanism further comprises a latching mechanism configured to protrude within a window retraction slot in a latched position.

18. The window insert assembly of item 17, wherein the latching mechanism comprises retractable latch bars rotatable between a vertical latched position protruding downwardly into the window retraction slot and an unlatched position outside of the window retraction slot.

19. The window insert assembly of any of items 11-18, wherein the lower edge of the window insert includes a further wedge surface angled in an opposite direction to the wedge surface, and the wedge assembly further includes a further complementary wedge surface disposed to slidingly abut against the further wedge surface.

20. The window insert assembly of item 19, wherein the wedge assembly comprises a front wedge body having the complementary wedge surface and a rear wedge body having the further complementary wedge surface, and the securing mechanism is operable to move the front wedge body and the rear wedge body together to apply a force on the window insert within the window frame, the force having an upward component, a rearward component, or both an upward component and a rearward component.

21. The window insert assembly of item 20, wherein the securing mechanism comprises a tension member interconnecting the front wedge body and the rear wedge body along the lower edge of the window insert, the tension member adjustably connected to the front wedge body.

22. The window insert assembly of item 21, wherein the tension member comprises a cord, a string, or a rod.

23. The window insert assembly of any of items 21-22, wherein the tension member further comprises a ratchet mechanism to hold the tension member under tension.

24. The window insert assembly of any of items 20-23, wherein the front wedge body is adjustably attached to the window insert.

25. The window insert assembly of any of items 1-24, wherein the attachment assembly includes an upper latching mechanism configured to protrude within an upper window track of the window frame in a latched position.

26. The window insert assembly of item 25, wherein the upper latching mechanism comprises retractable latch bars rotatable between a vertical latched position protruding upwardly into the window track and an unlatched position outside of the window track.

27. The window insert assembly of item 25, wherein the upper latching mechanism comprises fixed latch bars extending vertically above the upper edge of the window insert.

28. The window insert assembly of any of items 1-27, wherein the sheet of ballistic-resistant material comprises an acrylic material, a glass material, a ceramic material, or a polycarbonate, or combinations thereof.

29. The window insert assembly of any of items 1-28, wherein the window insert is able to provide ballistic protection of at least an NIJ Level 3A.

30. The window insert assembly of any of items 1-29, wherein the sheet of ballistic-resistant material comprises a transparent material or a translucent material or an opaque material.

31. A method of providing ballistic protection to a window opening in a vehicle door, comprising:

providing the window insert assembly of any of items 1-30;

attaching the window insert within the window opening in the vehicle door.

32. The method of item 31, wherein the attachment assembly comprises a wedge assembly, and further comprising placing the window insert of the window assembly within the window opening, and wedging the window insert within the opening with the wedge assembly disposed beneath the lower edge of the window insert.

33. The method of item 32, further comprising moving the wedge assembly rearwardly to apply a force on the window insert, the force having an upward component, a rearward component, or both an upward component and a rearward component.

34. The method of any of items 31-33, further comprising attaching the window insert within the window opening on an interior side of a stock window of the vehicle door.

35. The method of any of items 31-33, further comprising attaching the window insert within the window opening on an exterior side of a stock window of the vehicle door.

36. The method of any of items 31-34, further comprising attaching the window insert within the window opening at a location that does not interfere with operation of a stock window of the vehicle door.

37. A method of manufacturing the window insert assembly of any of items 1-30, comprising:

scanning a shape of a vehicle door; and forming the window insert to fit within a window frame of the vehicle door.

As used herein, "consisting essentially of" allows the inclusion of materials or steps that do not materially affect the basic and novel characteristics of the claim. Any recitation herein of the term "comprising," particularly in a description of components of a composition or in a description of elements of a device, can be exchanged with "consisting essentially of" or "consisting of."

It will be appreciated that the various features of the embodiments described herein can be combined in a variety of ways. For example, a feature described in conjunction with one embodiment may be included in another embodiment even if not explicitly described in conjunction with that embodiment.

The present invention has been described in conjunction with certain preferred embodiments. It is to be understood that the invention is not limited to the exact details of construction, operation, exact materials or embodiments shown and described, and that various modifications, substitutions of equivalents, alterations to the compositions, and other changes to the embodiments disclosed herein will be apparent to one of skill in the art.

What is claimed is:

1. A window insert assembly for a door of a vehicle, the window insert assembly comprising:

a window insert comprising a sheet of a ballistic-resistant material having a perimeter, the window insert including an upper edge, a rear edge, and a lower edge, at least one of the upper edge and the rear edge including a contour to mate with a window frame of the vehicle door, and the lower edge of the window insert includes a first wedge surface, the ballistic-resistant material providing ballistic resistance at a level of at least NIJ 3A; and an attachment assembly configured to attach the window insert within the window frame of the vehicle door proximate a window of the vehicle door, the attachment assembly comprising a wedge assembly including a second wedge surface disposed to slidingly abut against the first wedge surface of the window insert, and a securing mechanism operable to secure the wedge assembly in a position wherein the second wedge surface exerts a force on the first wedge surface of the window insert within the window frame, the force having an upward component, a rearward component, or both an upward component and a rearward component.

2. The window insert assembly of claim 1, wherein the force is configured to force the window insert upwardly against an upper edge of the window frame.

3. The window insert assembly of claim 2, wherein the force is further configured to force the window insert rearwardly against a rear edge of the window frame.

4. The window insert assembly of claim 1, wherein the force is configured to force the window insert rearwardly against a rear edge of the window frame.

5. The window insert assembly of claim 1, wherein the attachment assembly is configured to apply a force on the window insert within the window frame directed inwardly relative to the vehicle to prevent the window insert assembly from interfering with operation of the window of the vehicle door.

6. The window insert assembly of claim 1, wherein the upper edge of the window insert includes said contour which is contoured concavely to mate with an upper edge of the vehicle door window frame.

7. The window insert assembly of claim 6, wherein the rear edge of the window insert includes said contour which is contoured concavely to mate with a rear edge of the vehicle door window frame.

8. The window insert assembly of claim 1, wherein the rear edge of the window insert includes said contour which is contoured concavely to mate with a rear edge of the vehicle door window frame.

9. The window insert assembly of claim 1, wherein the attachment assembly is configured to mount the window insert within the window frame of the vehicle door on an interior side of the window of the vehicle door.

10. The window insert assembly of claim 1, wherein the lower edge of the window insert includes a third wedge surface parallel to the first wedge surface, and the wedge assembly further includes a fourth wedge surface disposed to slidingly abut against the third wedge surface.

11. The window insert assembly of claim 10, wherein the wedge assembly comprises a wedge body positionable beneath the lower edge of the window insert, the second wedge surface disposed at a front of the wedge body and the fourth wedge surface disposed at a rear of the wedge body.

12. The window insert assembly of claim 11, further comprising a flange upstanding from the wedge body, and a lip depending from the lower edge of the window insert to abut against the upstanding flange to prevent the window insert from moving inwardly toward an interior of the vehicle.

13. The window insert assembly of claim 1, wherein the securing mechanism comprises a securing strap attached between the wedge assembly and an inner surface of the vehicle door.

14. The window insert assembly of claim 13, wherein the securing strap is attached to the inner surface of the vehicle door with a hook and loop fastener.

15. The window insert assembly of claim 1, wherein the securing mechanism comprises a latching mechanism configured to protrude within a window retraction slot of the window frame.

16. The window insert assembly of claim 15, wherein the latching mechanism comprises a retractable latch bar rotatable between the latched position wherein said latch bar protrudes into the window retraction slot and an unlatched position.

17. The window insert assembly of claim 1, wherein the attachment assembly further includes an upper latching mechanism configured to protrude within an upper window track of the window frame.

18. The window insert assembly of claim 17, wherein the upper latching mechanism comprises retractable latch bars rotatable between a latched position protruding into the upper window track and an unlatched position.

19. The window insert assembly of claim 1, wherein the sheet of ballistic-resistant material comprises a material selected from the group consisting of an acrylic material, a glass material, a ceramic material, a polycarbonate, and combinations thereof.

20. The window insert assembly of claim 1, wherein the lower edge of the window insert includes a third wedge surface angled in an opposite direction to the wedge surface, and the first wedge assembly further includes a fourth wedge surface disposed to slidingly abut against the third wedge surface of the window insert.

21. The window insert assembly of claim 20, wherein the wedge assembly comprises a front wedge body having the second wedge surface and a rear wedge body having the fourth wedge surface, and the securing mechanism is operable to move the front wedge body and the rear wedge body together.

22. The window insert assembly of claim 21, wherein the securing mechanism comprises a tension member interconnecting the front wedge body and the rear wedge body, the tension member adjustably connected to the front wedge body.

23. A method of ballistically protecting a window opening, comprising:

providing the window insert assembly of claim 1;

attaching the window insert within the window frame of the vehicle door.

24. The method of claim 23, wherein the step of attaching the window insert within the window frame comprises placing the window insert within the window frame, and wedging the window insert within the window frame with the wedge assembly.

25. The method of claim 24, wherein the step of wedging the window insert within the window frame comprises moving the wedge assembly rearwardly relative to the window frame to apply the force on the window insert.

26. The method of claim 23, wherein the step of attaching the window insert within the window frame comprises attaching the window insert within the window frame on an interior side of the window of the vehicle door.

27. The method of claim 23, wherein the step of attaching the window insert within the window frame comprises attaching the window insert within the window frame such that the window insert does not interfere with operation of the window of the vehicle door.

* * * * *